US006566042B1

(12) United States Patent
Goto et al.

(10) Patent No.: US 6,566,042 B1
(45) Date of Patent: May 20, 2003

(54) METHOD FOR PRODUCING IMAGE AND HIGH-SPEED PHOTOTHERMOGRAPHIC MATERIAL

(75) Inventors: Takahiro Goto, Minami-ashigara (JP); Minoru Sakai, Minami-ashigara (JP); Katsuyuki Watanabe, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/717,110

(22) Filed: Nov. 22, 2000

(30) Foreign Application Priority Data

Nov. 24, 1999 (JP) ..... 11-332262
Mar. 17, 2000 (JP) ..... 2000-075302

(51) Int. Cl.[7] ..... G03C 5/16; G03C 1/498
(52) U.S. Cl. ..... 430/350; 430/531; 430/600; 430/607; 430/613; 430/614; 430/617; 430/619
(58) Field of Search ..... 430/350, 619, 430/531, 600, 607, 613, 614, 617

(56) References Cited

U.S. PATENT DOCUMENTS 5,545,515 A * 8/1996 Murray et al. ..... 430/619
5,952,167 A * 9/1999 Okada et al. ..... 430/619
6,040,130 A * 3/2000 Alton et al. ..... 430/617
6,083,680 A * 6/2000 Ito et al. ..... 430/619
6,074,813 A1 * 6/2001 Asanuma et al. ..... 430/613

FOREIGN PATENT DOCUMENTS

GB 1498406 1/1978

* cited by examiner

*Primary Examiner*—Thorl Chea
(74) *Attorney, Agent, or Firm*—Birch, Stewart, Kolasch & Birch, LLP

(57) ABSTRACT

A method for producing an image comprising a step for heat-developing after light exposure a photothermographic material containing elsewhere on a support a non-photosensitive organic acid silver salt, a photosensitive silver halide, a nucleation aid, a binder and at least one compound expressed by the formula (A) below, at a line speed of 140 cm/min or faster:

(A)

[where $R^1$, $R^2$, $R^3$, $X^1$ and $X^2$ independently represent a hydrogen atom, halogen atom or the like; at least either one of $X^1$ and $X^2$ is a group expressed as —$NR^4R^5$, where $R^4$ and $R^5$ independently represents a hydrogen atom, alkyl group or the like] is provided. The method for producing an image of the present invention is successful in raising $D_{max}$ (maximum density), suppressing increase in fog during a long-term storage, and suppressing dimensional instability of line width affected by the energy of exposure.

12 Claims, 1 Drawing Sheet

METHOD FOR PRODUCING IMAGE AND HIGH-SPEED PHOTOTHERMOGRAPHIC MATERIAL

FIELD OF THE INVENTION

The present invention relates to a technology for producing an image at a high speed by heat-developing a photothermographic material. The present invention is in particular beneficial in image production on a photothermographic material using a scanner or image setter suitable for photoengraving.

RELATED ART

There are a variety of known photosensitive materials having on a support a photosensitive layer and capable of producing an image by image-wise light exposure. Among these, a material for producing an image by heat development can compose a system responsible for achieving environmental preservation and simplifying an image producing means.

A strong need for reducing the volume of the waste of processing solution has arisen in recent years in the field of photoengraving from viewpoints of environmental preservation and space saving. Thus a technology related to a photothermographic material for photoengraving has been desired, in which the material being such that allowing efficient light exposure with a laser image setter or laser imager, and providing a black image with a high resolution and sharpness. Such photothermographic material can provide the user with a more simple and environment-conscious image producing system using no solution-base process chemicals.

Exemplary methods for producing an image by heat development are, for example, found in U.S. Pat. Nos. 3,152,904 and 3,457,075 and "Thermally Processed Silver Systems" by D. Klosteraboer, Imaging Processes and Materials, Neblette's 8th ed., edited by Sturge, V. Walworth and A. Shepp, Chapter 9, p.279, (1989). Such photothermographic material contains a reducible non-photosensitive silver source (e.g., organic acid silver salt), a catalytic amount of a photocatalyst (eg., silver halide) and a reducing agent for reducing silver, all of which being generally dispersed in an organic binder matrix. While the photothermographic material is stable at the normal temperature, it can produce a black silver image when heated, after light exposure, to a high temperature (e.g., 80. C. or above) through redox reaction of the reducible silver source (acts as an oxidant) with the reducing agent. The redox reaction is promoted by a catalytic action of a latent image produced by the light exposure. Silver produced from the reducible silver source within the exposed area is blackened, which creates a contrast to a non-exposed area to thereby produce an image.

Many of the conventional photothermographic material have an image producing layer formed by coating a coating liquid which contains as a solution medium an organic solvent such as toluene, methyl ethyl ketone (MEK) or methanol. Using an organic solvent as a solution medium, however, is not only hazardous to human body, but is also disadvantageous in terms of the production cost since it calls for additional process steps such as for recovering the solvent.

Thus a method for forming, using a water-base coating liquid, the image producing layer is proposed. For example, JP-A-49-52626 (the code "JP-A" as used herein means an "unexamined published Japanese patent application") and JP-A-53-116144 disclose an image producing layer containing gelatin as a binder. In JP-A-50-151138, an image producing layer using polyvinyl alcohol as a binder is described. An image producing layer based. on a combined use of gelatin and polyvinyl alcohol is found in JP-A-60-61747. Still another example of an image producing layer relates to that using a water-soluble polyvinyl acetal as a binder described in JP-A-58-28737. Using such water-soluble binders allows the image producing layer to be formed with a water-base coating liquid and is beneficial from environmental and economic viewpoints.

For the purpose of obtaining a high-contrast photographic property, European Laid-Open Patent Publication No. 762, 196 and JP-A-9-90550 disclose a photothermographic material containing, in addition to a photosensitive silver halide grain, a metal ion of Group VII or VIII, a complex of such metal or a hydrazine derivative.

While various improvements have been made on environmental, cost and photographic properties of the photothermographic material as described in the above, there still remains a room for improvement in the speed of the heat development. Using the film in the field of photoengraving such as for newspaper generally requires rapid processing of the film in pursuit of productivity. The photothermographic material, however, suffers from a problem that the dependence of line width of characters (practical sensitivity) on the energy of light exposure is larger than that of the conventional film based on chemical processing, which prevents rapid heat development at a higher line speed.

So that there is a strong need for a high-speed photothermographic material low in the exposure energy dependence and stable in the character line width, and is most suitable for photoengraving.

Another problem arises from a situation that it is not so usual that the photothermographic material is used immediately after the production, and the material is usually put into practical use after a certain duration of time while being kept wrapped and marketed. Some of the conventional photothermographic material, however, become impractical when used after a long period of storage. Thus there is a strong need for degradation resistance of the photothermographic material even in the use after a long period of storage.

It is therefore an object of the present invention to provide a photothermographic material (particularly for use in photoengraving and more particularly for use with a scanner or image setter) allowing rapid development processing while successfully suppressing widening of character line width or fogging, and having an excellent storability. It is another object of the present invention to provide a method for rapidly producing a quality image while suppressing the widening of character line width or fogging during the development process.

SUMMARY OF THE INVENTION

The present inventors found out, after extensive studies, that the foregoing object is attainable by using a photothermographic material containing a specific compound and by heat-developing such material at a high line speed of a certain range, which led us to propose the present invention.

That is, the present invention provides a method for producing an image comprising a step for heat-developing after light exposure a photothermographic material containing elsewhere on a support a non-photosensitive organic acid silver salt, a photosensitive silver halide, a nucleation aid, a binder and at least one compound expressed by the formula (A) below, at a line speed of 140 cm/min or faster:

(A)

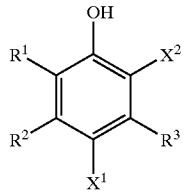

[where $R^1$, $R^2$, $R^3$, $X^1$ and $X^2$ independently represent a hydrogen atom, halogen atom, or a substituent bound via any one of carbon atom, oxygen atom, nitrogen atom, sulfur atom and phosphorus atom toa benzene ring;

at least either one of $X^1$ and $X^2$ is a group expressed as —$NR^4R^5$, where $R^4$ and $R^5$ independently represents a hydrogen atom, alkyl group, alkenyl group, alkynyl group, aryl group or a group expressed by —C(=O)—$R^6$, —C(=O)—C(=O)—$R^6$, —$SO_2$—$R^6$, —SO—$R^6$ or —P(=O)(—$R^6$)—$R^7$, and where $R^6$ and $R^7$ independently represent a hydrogen atom, alkyl group, alkenyl group, alkynyl group, aryl group, heterocyclic group, amino group, hydroxyl group, alkoxy group and aryloxy group; adjacent ones of these substituents may bind with each other to form a ring].

In the method for producing an image of the present invention, it is preferable that the photothermographic material further contains two or more compounds as expressed by the formula (1) below:

$$Q—(Y)_n—C(Z^1)(Z^2)X \quad (1)$$

[where Q represents an alkyl group, aryl group or heterocyclic group, all of which may further have a substituent; Y represents a bivalent linking group; n represents 0 or 1; $Z^1$ and $Z^2$ independently represent a halogen atom; and X represents a hydrogen atom or electron attractive group].

In the method for producing an image of the present invention, the photothermographic material is preferably heat-developed at the a line speed of 140 cm/min to 700 cm/min, the light exposure is preferably effected for $10^{-15}$ seconds to $10^{-7}$ seconds and at an exposure energy of 5 $\mu J/cm^2$ to 1 $mJ/cm^2$, and the light exposure is preferably effected using a multi-beam exposing apparatus provided with two or more laser heads.

The present invention also provides a high-speed photothermographic material containing elsewhere on a support a non-photosensitive organic acid silver salt, a photosensitive silver halide, a nucleation aid, a binder and at least one compound expressed by the formula (A) and two or more compounds as expressed by the formula (1). In the high-speed photothermographic material of the present invention, it is preferable that at least one compound expressed by Q is an electron attractive group expressed by the formula (1), and at least one compound expressed by Q is an electron attractive group expressed by the formula (2) below;

(2)

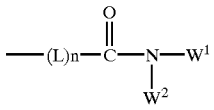

[where L represents a linking group; $W^1$ and $W^2$ independently represent a hydrogen atom, alkyl group, aryl group or heterocyclic group; and n represents 0 or 1], and the photosensitive silver halide and binder are contained in a image producing layer of the photothermographic material, and 50 wt % or more of the binder is preferably composed of a polymer latex having a glass transition point of −30° C. to 40° C.

BRIEF DESCRIPTION OF THE DRAWING

The above and other objects and features of the invention are apparent to those skilled in the art from the following referred embodiments thereof when considered in conjunction with the accompanied drawing, in which.

DETAILED DESCRIPTION OF THE INVENTION

Figure 1:
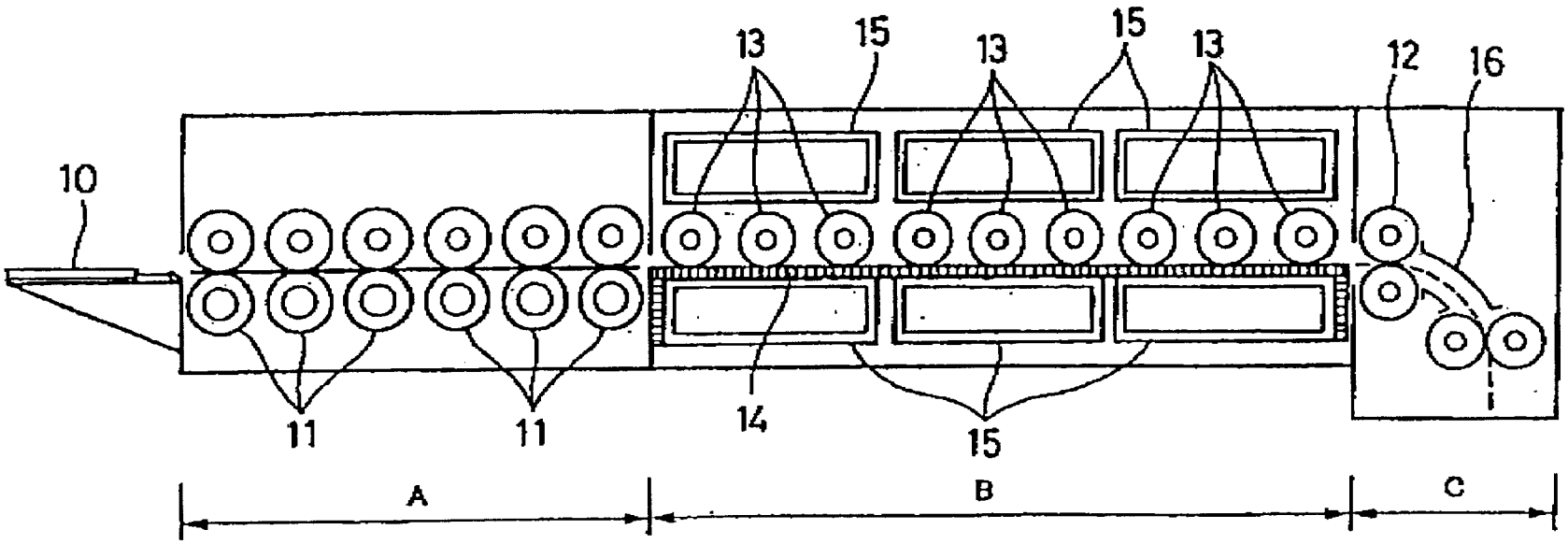
FIG. 1 is a side view showing an exemplary constitution of a heat developing apparatus used for heat-developing the photothermographic material of the present invention.

The method for producing an image and the high-speed photothermographic material of the present invention will be explained properly referring to the best modes thereof. Now the expression of range of values with a term "to" in this specification is defined as both end values placed before and after "to" being inclusive as a minimum value and a maximum value, respectively.

In the present invention, a compound expressed by the formula (A) is used for the photothermographic material. Now the compound expressed by the formula (A) will be detailed.

$R^1$, $R^2$ and $R^3$ independently represent a hydrogen atom, halogen atom, or a substituent bound via any one of carbon atom, oxygen atom, nitrogen atom, sulfur atom and phosphorus atom to a benzene ring. Among such substituents other than hydrogen atom and halogen atom, those bound to a benzene ring via carbon atom(s) include straight-chained, branched or cyclic alkyl group, alkenyl group, alkynyl group, aryl group, acyl group, alkoxycarbonyl group, aryloxycarbonyl group, carbamoyl group, cyano group, carboxyl group, heterocyclic group, sulfonylcarbamoyl group, acylcarbamoyl group, sulfamoylcarbamoyl group, carbazolyl group, oxalyl group, oxamoyl group and thiocarbamoyl group. Those bound via an oxygen atom include hydroxyl group, alkoxy group, aryloxy group, heterocyclic oxy group, acyloxy group (alkoxy or aryloxy)carbonyloxy group, carbamoyloxy group and sulfonyloxy group. Those bound via a nitrogen atom include amino group, nitro group, hydrazino group, heterocyclic group, acylamino group (alkoxy or aryloxy)carbonylamino group, sulfonamide group, sulfamoylamino group, semicarbazide group, thiosemicarbazide group, quaternary ammonio group, oxamoylamino group, ureide group, thioureide group (alkyl or aryl)sulfonylureide group, acylureide group, acylsulfamoylamino group, phosphorylamino group and imido group. Those bound via sulfur atom(s) include mercapto group, disulfide group, sulfo group, sulfino group, sulfonylthio group, thiosulfonyl group, alkylthio group, arylthio group, sulfonyl group, sulfinyl group, sulfamoyl group, acylsulfamoyl group, sulfonylsulfamoyl group, sulfo group and heterocyclic thio group. Those bound via a phosphorus atom include phosphonyl group and phosphinyl group. All of these substituents may further be substituted with any of these substituent.

$X^1$ and $X^2$ independently represent a hydrogen atom, halogen atom, or a substituent bound via any one of carbon atom, oxygen atom, nitrogen atom, sulfur atom and phosphorus atom to a benzene ring. When $X^1$ and $X^2$ represent a substituent other than a hydrogen atom and halogen atom, specific example thereof can be selected from the substituents exemplified in the above for $R^1$, $R^2$ and $R^3$. Now at least either of $X^1$ and $X^2$ must be a group expressed as $—NR^4R^5$, where $R^4$ and $R^5$ independently represents a hydrogen atom, alkyl group, alkenyl group, alkynyl group, aryl group or a group expressed by $—C(=O)—R^6$, $—C(=O)—C(=O)—R^6$, $—SO_2—R^6$, $—SO—R^6$ or $—P(=O)(—R^6)—R^7$. $R^6$ and $R^7$ independently represent a hydrogen atom, alkyl group, alkenyl group, alkynyl group, aryl group, heterocyclic group, amino group, hydroxyl group, alkoxy group and aryloxy group. Adjacent ones of these substituents may bind with each other to form a ring.

Next, a preferable range of the compound expressed by the formula (A) will be detailed.

Preferable examples of $R^1$, $R^2$ and $R^3$ include a hydrogen atom, halogen atom, straight-chained, branched or cyclic, substituted or unsubstituted $C_{1-20}$ alkyl groups (e.g., methyl, ethyl, propyl, isopropyl, tert-butyl, n-octyl, tert-amyl, 1,3-tetramethylbutyl, cyclohexyl, trifluoromethyl and difluoromethyl groups); $C_{1-20}$ alkenyl groups (e.g., vinyl, allyl, 2-butenyl and 3-pentenyl groups); $C_{1-20}$ alkynyl groups (e.g., propargyl and 3-pentynyl groups); $C_{6-20}$ aryl groups (e.g., phenyl, p-methylphenyl and naphthyl groups); $C_{1-20}$ acyl groups (e.g., acetyl, benzoyl, formyl and pivaloyl groups); $C_{1-20}$ alkoxycarbonyl groups (e.g., methoxycarbonyl and ethoxycarbonyl groups); $C_{7-20}$ aryloxycarbonyl groups (e.g., phenoxycarbonyl group); $C_{1-20}$ carbamoyl groups (e.g., carbamoyl, diethylcarbamoyl and phenylcarbamoyl groups); cyano group; carboxyl group; $C_{1-20}$ heterocyclic groups (e.g., 1-imidazolyl, morpholyl and 3-pyrazolyl groups); hydroxyl group; $C_{1-20}$ alkoxy groups (e.g., methoxy, ethoxy and butoxy groups); $C_{6-20}$ aryloxy groups (e.g., phenyloxy and 2-naphthyloxy groups); $C_{1-20}$ heterocyclic oxy groups (e.g., 4-pyridyloxy group); $C_{2-20}$ acyloxy groups (e.g., acetoxy and benzoyloxy groups); $C_{0-20}$ amino groups (e.g., amino, methylamino, dimethylamino, diethylamino and dibenzylamino groups); nitro group; $C_{1-20}$ acylamino groups (e.g., acetylamino and benzoylamino groups); $C_{2-20}$ alkoxycarbonylamino groups (e.g., methoxycarbonylamino group); $C_{7-20}$ aryloxycarbonylamino groups (e.g., phenyloxycarbonylamino group); $C_{1-20}$ sulfonamide groups (e.g., methanesulfonamide and benzenesulfonamide groups); $C_{1-20}$ sulfamoylamino groups; $C_{0-20}$ sulfamoyl groups (e.g., sulfamoyl, methylsulfamoyl, dimethylsulfamoyl and phenylsulfamoyl groups); $C_{0-20}$ ureide groups (e.g., ureide, methylureide and phenylureide groups); $C_{2-20}$ imide groups (e.g., succinimide, phthalimide and trifluoromethanesulfonimide groups); mercapto group; $C_{1-20}$ disulfide groups; sulfo group; sulfino group; $C_{1-20}$ alkylthio groups (e.g., methylthio and ethylthio groups); $C_{6-20}$ arylthio groups (e.g., phenylthio group); $C_{1-20}$ sulfonyl groups (e.g., mesyl, tosyl and phenylsulfonyl groups); $C_{1-20}$ sulfinyl groups (e.g., methanesulfinyl and benzenesulfinyl groups); $C_{1-20}$ heterocyclic thio groups (e.g., 2-imidazolylthio group); $C_{1-20}$ phosphinyl groups (e.g., diethoxyphosphinyl and diphenylphosphinyl groups); $C_{1-20}$ phosphorylamino groups (e.g., diethylphosphorylamino group).

More preferable examples of $R^1$, $R^2$ and $R^3$ include a hydrogen atom, halogen atom, straight-chained, branched or cyclic, substituted or unsubstituted alkyl group, aryl group, acyl group, alkoxycarbonyl group, aryloxycarbonyl group, cyano group, carboxyl group, carbamoyl group, heterocyclic group, hydroxyl group, alkoxy group, aryloxy group, acyloxy group, amino group, nitro group, acylamino group, alkoxycarbonylamino group, aryloxycarbonylamino group, sulfonamide group, imide group, mercapto group, sulfo group, alkylthio group, arylthio group, sulfonyl group and sulfamoyl group.

Still more preferable examples of $R^1$, $R^2$ and $R^3$ include a hydrogen atom, halogen atom, straight-chained, branched or cyclic, substituted or unsubstituted alkyl group, aryl group, acyl group, alkoxycarbonyl group, aryloxycarbonyl group, cyano group, carboxyl group, carbamoyl group, hydroxyl group, alkoxy group, aryloxy group, acyloxy group, nitro group, acylamino group, sulfonamide group, mercapto group, sulfo group, alkylthio group, arylthio group, sulfonyl group and sulfamoyl group.

Preferable examples of $X^1$ and $X^2$ other than those expressed as $—NR^4R^5$ can be selected from preferable examples of $R^1$, $R^2$ and $R^3$, and more preferable examples thereof can also be selected from the corresponded more preferable examples.

Preferable examples of $R^4$ and $R^5$ in $—NR^4R^5$ other than those expressed as $—C(=O)—R^6$, $—C(=O)—C(=O)—R^6$, $—SO_2—R^6$, $—SO—R^6$ or $—P(=O)(—R^6)—R^7$ include a hydrogen atom, straight-chained, branched or cyclic, substituted or unsubstituted $C_{1-20}$ alkyl groups (e.g., methyl, ethyl, propyl, isopropyl, tert-butyl, n-octyl, tert-amyl, 1,3-tetramethylbutyl, cyclohexyl, trifluoromethyl and difluoromethyl groups); $C_{1-20}$ alkenyl groups (e.g., vinyl, allyl, 2-butenyl and 3-pentenyl groups); $C_{1-20}$ alkynyl groups (e.g., propargyl and 3-pentynyl groups); $C_{1-20}$ aryl groups (e.g., phenyl, p-methylphenyl and naphthyl groups). Among these more preferable are a hydrogen atom, straight-chained, branched or cyclic, substituted or unsubstituted $C_{1-10}$ alkyl groups, $C_{1-10}$ alkenyl groups, $C_{1-10}$ alkynyl groups and $C_{6-12}$ aryl groups.

Preferable examples of $R^6$ and $R^7$ in the groups expressed as $—C(=O)—R^6$, $—C(=O)—C(=O)—R^6$, $—SO_2—R^6$, $—SO—R^6$ or $—P(=O)(—R^6)—R^7$ include a hydrogen atom, straight-chained, branched or cyclic, substituted or unsubstituted $C_{1-20}$ alkyl groups (e.g., methyl, ethyl, propyl, isopropyl, tezt-butyl, n-octyl, tert-amyl, 1,3-tetramethylbutyl, cyclohexyl, trifluoromethyl and difluoromethyl groups); $C_{1-20}$ alkenyl groups (e.g., vinyl, allyl, 2-butenyl and 3-pentenyl groups); $C_{1-20}$ alkynyl groups (e.g., propargyl and 3-pentynyl groups); $C_{6-20}$ aryl groups (e.g., phenyl, p-methylphenyl and naphthyl groups); hydroxyl group; $C_{1-20}$ alkoxy groups (e.g., methoxy, ethoxy and butoxy groups); $C_{6-20}$ aryloxy groups (e.g., phenyloxy and 2-naphthyloxy groups); $C_{1-20}$ heterocyclic oxy groups (e.g., 4-pyridyloxy group); $C_{0-20}$ amino groups (e.g., amino, methylamino, dimethylamino, diethylamino and dibenzylamino groups); and $C_{1-20}$ heterocyclic group (e.g., 1-imidazolyl, morpholyl and 3-pyrazolyl groups). More preferable examples include a hydrogen atom, straight-chained, branched or cyclic, substituted or unsubstituted $C_{1-10}$ alkyl groups; $C_{1-10}$ alkenyl groups; $C_{1-10}$ alkynyl groups; $C_{6-12}$ aryl groups; hydroxyl group; $C_{1-10}$ alkoxy groups; $C_{6-12}$ aryloxy groups; $C_{1-10}$ heterocyclic oxy groups; $C_{0-10}$ amino groups; and $C_{1-10}$ heterocyclic group. More preferable examples include a hydrogen atom, straight-chained, branched or cyclic, substituted or unsubstituted $C_{1-10}$ alkyl groups; $C_{6-12}$ aryl groups; hydroxyl group; $C_{1-10}$ alkoxy groups; $C_{6-12}$ aryloxy groups; $C_{0-10}$ amino groups; and $C_{1-10}$ heterocyclic group.

In a preferable compound expressed by the formula (A), $R^1$, $R^2$ and $R^3$ are independently selected from a hydrogen atom, halogen atom, straight-chained, branched or cyclic, substituted or unsubstituted alkyl group, aryl group, acyl group, alkoxycarbonyl group, aryloxycarbonyl group, cyano group, carboxyl group, carbamoyl group, hydroxyl group, alkoxy group, aryloxy group, acyloxy group, nitro group, acylamino group, sulfonamide group, mercapto group, sulfo group, alkylthio group, arylthio group, sulfonyl group and sulf amoyl group; either one of $X^1$ and $X^2$ is selected from a hydrogen atom, halogen atom, straighthained, branched or cyclic, substituted or unsubstituted alkyl group, aryl group, acyl group, alkoxycarbonyl group, aryloxycarbonyl group, cyano group, carboxyl group, carbamoyl group, hydroxyl group, alkoxy group, aryloxy group, acyloxy group, nitrogroup, acylamino group, sulfonamide group, mercapto group, sulfo group, alkylthio group, arylthio group, sulfonyl group and sulfamoyl group and the other is expressed as $—NR^4R^5$, where either one of $R^4$ and $R^5$ is expressed as $—C(=O)—R^6$, $—C(=O)—C(=O)—R^6$, $—SO_2—R^6$, $—SO—R^6$ or $—P(=O)(—R^6)—R^7$.

In more preferable compounds expressed by the formula (A), $R^1$, $R^2$ and $R^3$ are independently selected from a hydrogen atom, halogen atom, straight-chained, branched or cyclic, substituted or unsubstituted alkyl group, aryl group, acyl group, alkoxycarbonyl group, aryloxycarbonyl group, cyano group, carbamoyl group, hydroxyl group, acylamino group, sulfonamide group, sulfonyl group and sulfamoyl group; either one of $X^1$ and $X^2$ is selected from a hydrogen atom, halogen atom, straight-chained, branched or cyclic, substituted or unsubstituted alkyl group, aryl group, acyl group, alkoxycarbonyl group, aryloxycarbonyl group, cyano group, carbamoyl group, hydroxyl group, acylamino group, sulfonamide group, sulfonyl group and sulfamoyl group and the other is expressed as $—NR^4R^5$, where either one of $R^4$ and $R^5$ is expressed as $—C(=O)—R^4$, $—SO_2—R^6$ or $—P(=O)(—R^6)—R^7$.

These substituents may further be substituted by the foregoing substituents. The substituent having a highly acidic hydrogen atom may form a salt by dissociating the hydrogen atom in a form of proton. A counter ion available in such case can be a metal ion, ammonium ion or phosphonium ion. Such state of the dissociation of an active hydrogen can be an effective measure for addressing the case in which volatility of the compound during the development is in problem.

For a compound expressed by the formula (A) having only one phenol structure per molecule, the total carbon number of the substituents is preferably 1 to 200, more preferably 1 to 150, and still more preferably 1 to 100. This, however, does not apply to the case in which a plurality of such phenol structures are bound to a polymer chain, where the polymer as a whole may have an average molecular weight of 500,000 or below. It is also effective to use a bis- or tris-compound linked with a $C_{1-100}$ linking group. Raising the molecular weight to such level can be an effective measure for addressing the case in which volatility of the compound during the development is in problem.

The compounds expressed by the formula (A) used in the present invention may be incorporated with an adsorptive group capable of adsorbing silver halide. Examples of such adsorptive group include alkylthio group, arylthio group, thiourea group, thioamide group, mercapto heterocyclic group or triazole group; all of which are disclosed in, for example, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. The adsorptive group for the silver halide may have a form of a precursor Such precursor is exemplified as that disclosed in JP-A-2-285344.

The compound expressed by the formula (A) available in the present invention may contain in the molecular structure thereof a ballast group or polymer commonly used in immobile photographic additives such as a coupler. The ballast group refers to a group relatively inactive with regard to photographic characteristics having a carbon number of 8 or larger, and can be selected from, for example, alkyl group, aralkyl group, alkoxy group, phenyl group, alkylphenyl group, phenoxy group, alkylphenoxy group and so forth. The polymer can be exemplified as that disclosed in JP-A-1-100530.

The compound expressed by the formula (A) used in the present invention may be incorporated with a cationic group (e.g., a group containing quaternary ammonio group, or nitrogen-containing heterocycle containing a quaternized nitrogen atom); a group containing repetitive units of ethyleneoxy group or propyleneoxy group; (alkyl, aryl or heterocyclic)thio group; or dissociative group capable of dissociating under the presence of base (e.g., carboxyl group, sulfo group, acylsulfamoyl group, carbamoylsulfamoyl group). Specific examples of these groups are disclosed, for example, in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific and preferable examples of the compound expressed by the formula (A) used for the present invention will be shown below, while being not limited thereto.

A-1

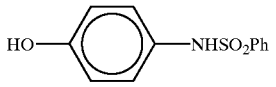

A-2

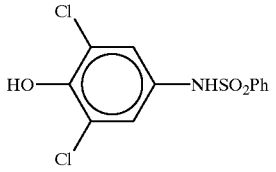

A-3

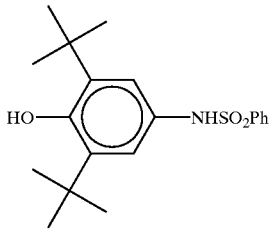

A-4

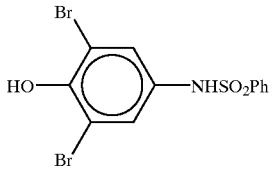

-continued
A-5
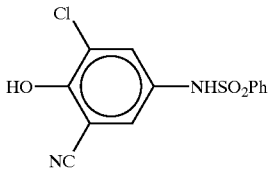
A-6
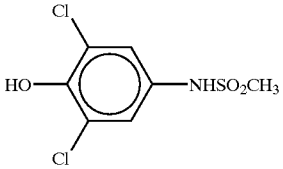
A-7
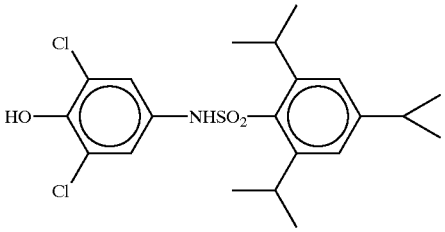
A-8
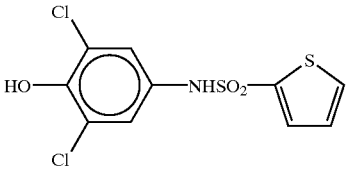
A-9
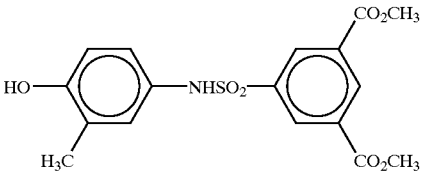
A-10
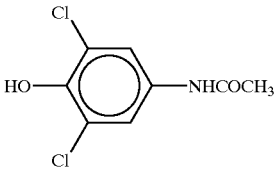
A-11
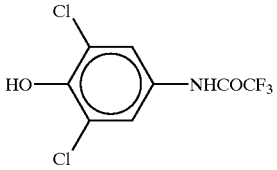
A-12
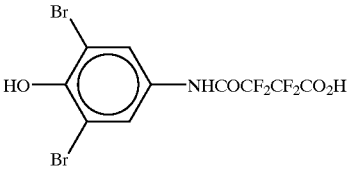
-continued
A-13
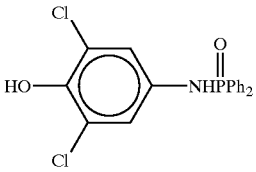
A-14
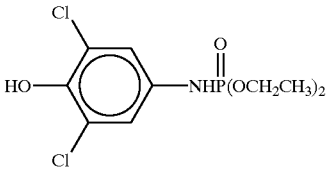
A-15
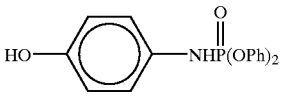
A-16
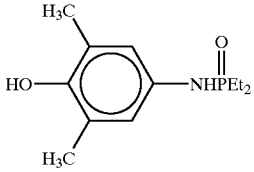
A-17
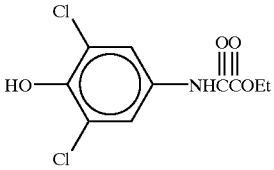
A-18
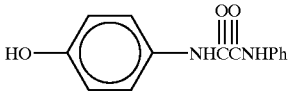
A-19
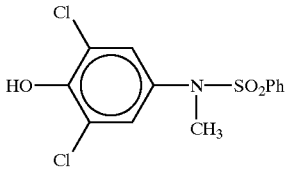
A-20
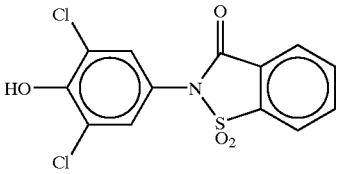
A-21
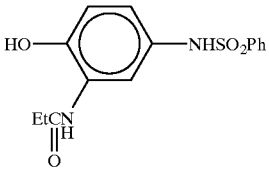

-continued
A-22
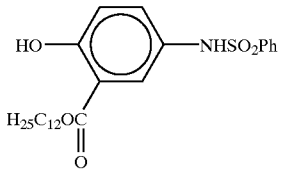
A-23
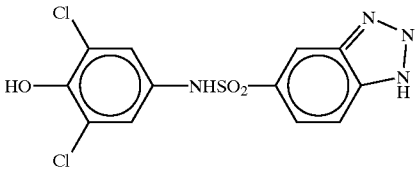
A-24
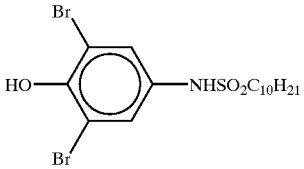
A-25
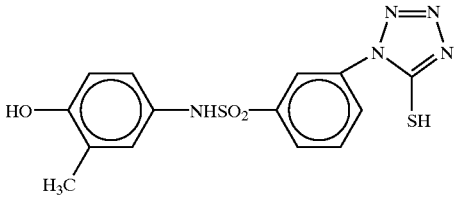
A-26
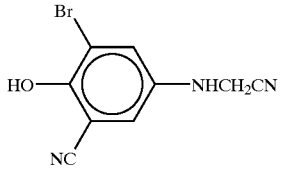
A-27
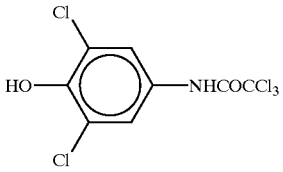
A-28
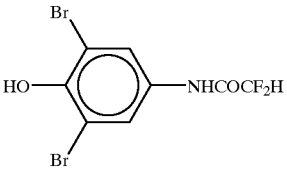
A-29
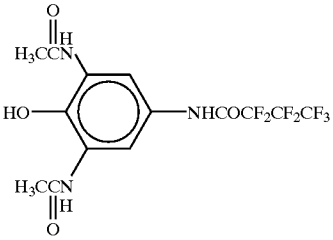
-continued
A-30
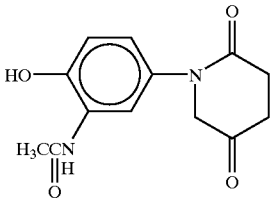
A-31
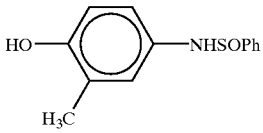
A-32
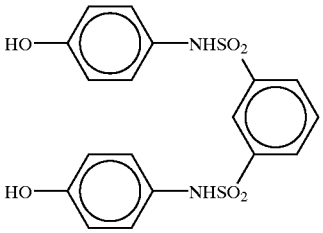
A-33
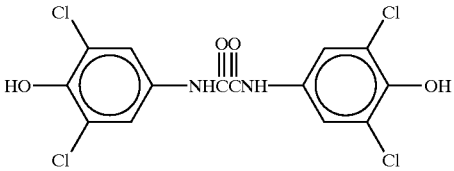
A-34
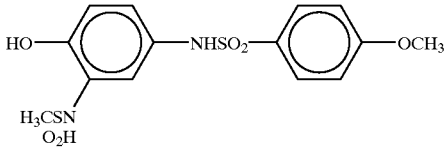
A-35
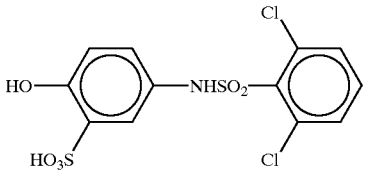
A-36
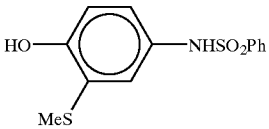
A-37
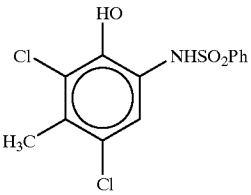

-continued
A-38
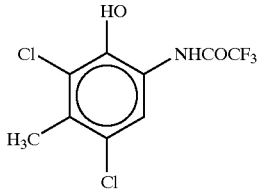
A-39
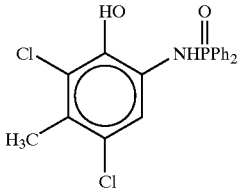
A-40
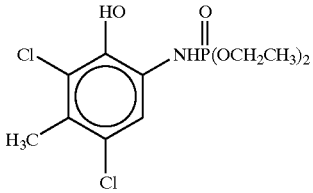
A-41
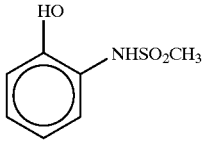
A-42
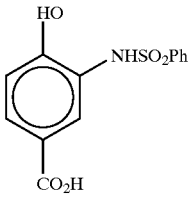
A-43
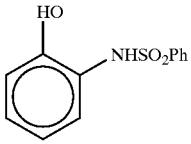
A-44
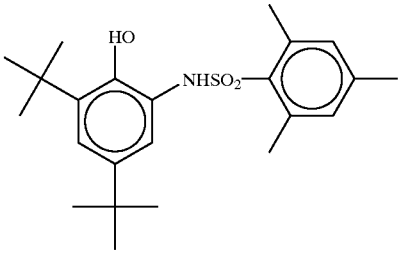
A-45
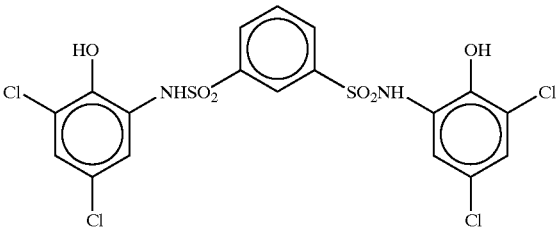
-continued
A-46
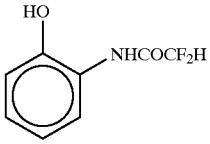
A-47
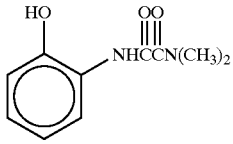
A-48
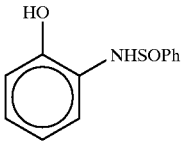
A-49
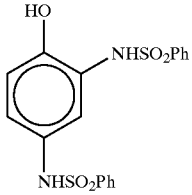
A-50
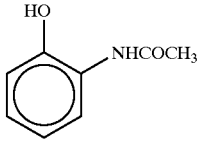
A-51
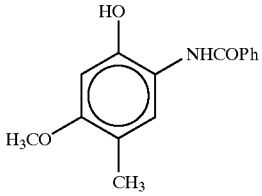
A-52
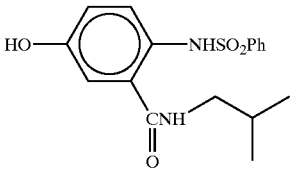
A-53
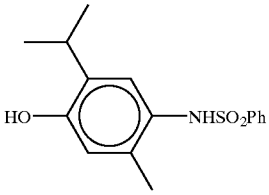

-continued

A-54

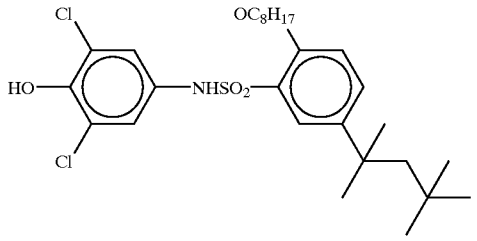

A-55

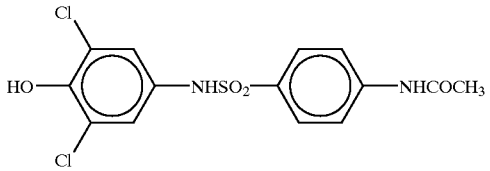

The compound expressed by the formula (A) can readily be synthesized according to known methods referring, for example, JP-A-49-80386, JP-A-5-257227 and JP-A-10-221806.

An amount of use of the compound expressed by the formula (A) is preferably from $1\times10^{-6}$ to $2\times10^{-1}$ mol per mol of organic acid silver salt employed, and more preferably from $1\times10^{-5}$ to $1\times10^{-1}$ mol, and still more preferably from $5\times10^{-4}$ to $5\times10^{-2}$ mol.

The compound expressed by the formula (A) of the present invention can be used as dissolved in water or other appropriate organic solvents such as alcohols (methanol, ethanol, propanol, fluorinated alcohol), ketones (acetone, methyl ethyl ketone, methyl isobutyl ketone), dimethylformamide, dimethylsulfoxide and Methyl Cellosolve.

The compound can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powder of such compound is dispersed into water with the aid of a ball mill, colloid mill, sand grinder mill, Mantone galling, micro-fluidizer or ultrasonic wave.

The compound expressed by the formula (A) of the present invention can be added to any layer provided on the same side with the image producing layer as viewed from a support, that is to the image producing layer and the layer on the same side therewith, where addition to the image producing layer or to the layer adjacent thereto is preferable.

It is preferable that the compound expressed by the formula (A) of the present invention is used together with a reducing agent for reducing the organic acid silver salt described later. Preferable reducing agent refers to a so-called hindered phenol compound having only one hydroxyl group on a benzene ring and one substituent at least on one ortho position of such hydroxyl group. Specific examples are exemplified as those disclosed, for example, in U.S. Pat. No. 5,496,695, JP-A-9-274274 and JP-A-9-304876.

Next, the compound expressed by the formula (1) below:

$$Q—(Y)_n—C(Z^1)(Z^2)X \quad (1)$$

for use in the photothermographic material of the present invention will be detailed.

In the formula (1), Q represents an alkyl group, aryl group or heterocyclic group, all of which may further have a substituent; Y represents a bivalent linking group; n represents 0 or 1; $Z^1$ and $Z^2$ independently represent a halogen atom; and X represents a hydrogen atom or electron attractive group].

In the formula (1), Q represents an alkyl group, aryl group or heterocyclic group, all of which may further have a substituent.

The alkyl group expressed by Q is a straight-chained, branched or cyclic alkyl group, and preferably has a carbon number of 1 to 20, more preferably 1 to 12 and still more preferably 1 to 6. Examples of such alkyl group include methyl group, ethyl group, n-propyl group, isopropyl group, sec-butyl group, isobutyl group, tert-butyl group, sec-pentyl group, isopentyl group, tert-pentyl group, tert-octyl group and 1-methylcyclohexyl group. Among these preferable are tertiary alkyl groups.

The alkyl group expressed by Q may have any substituent, and such substituent may be any group unless otherwise it adversely affects the photographic properties. Examples of such substituent include halogen atom (fluorine atom, chlorine atom, bromine atom or iodine atom), alkyl group, alkenyl group, alkynyl group, aryl group, heterocyclic group (N-substituted nitrogen-containing heterocyclic group, such as morpholino group, included), alkoxycarbonyl group, aryloxycarbonyl group, carbamoyl group, imino group, N-substituted imino group, thiocarbonyl group, carbazolyl group, cyano group, thiocarbamoyl group, alkoxy group, aryloxy group, heterocyclic oxy group, acyloxy group, (alkoxy or aryloxy)carbonyloxy group, sulfonyloxy group, acylamide group, sulfonamide group, ureide group, thioureide group, imido group, (alkoxy or aryloxy)carbonylamino group, sulfamoylamino group, semicarbazide group, thiosemicarbazide group, (alkyl or aryl)sulfonylureide group, nitro group, (alkyl or aryl)sulfonyl group, sulfamoyl group, group containing phosphate amide or phosphate ester structure, silyl group, carboxyl group or salt thereof, sulfo group or salt thereof, phosphate group, hydroxyl group and quaternary ammonium group. These substituents may further be substituted by these substituents.

The aryl group expressed by Q of the formula (1) has a monocyclic or condensed ring structure, and preferably has a carbon number of 6 to 16, and more preferably 6 to 10. Phenyl group and naphthyl group are preferable examples.

The aryl group expressed by Q may have any substituent, and such substituent may be any group unless otherwise it adversely affects the photographic properties. Specific examples thereof may be those exemplified for the alkyl group described above.

The heterocyclic group expressed by Q is preferably a five- or seven-membered, saturated or unsaturated, monocyclic or condensed ring containing at least one hetero atom selected from the group consisting of nitrogen, oxygen and sulfur. Preferable examples of such heterocyclic group include pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole,thiadiazoleandtriazole. Amongthesemore preferable are pyridine, quinoline, pyrimidine, thiadiazole and benzothiazole; and still more preferable are pyridine, quinoline and pyrimidine.

The heterocyclic group expressed by Q may have a substituent, and examples thereof may be those exemplified for the alkyl group expressed by Q of the formula (1).

Q is preferably a phenyl group, naphthyl group, quinolyl group pyridyl group, pyrimidyl group, thiadiazolyl group or benzotiazolyl group, and more preferably phenyl group, naphthyl group, quinolyl group pyridyl group or pyrimidyl group.

The substituent for Q may be a ballast group generally used for photographic material for suppressing the dispersion property, or a group for exhibiting adhesion property to the silver salt or water solubility, may polymerize with each other to form a polymer, or may bind with each other to form a bis-, tris- or tetrakis-compound.

Y in the formula (1) represents a bivalent linking group, and is preferably —$SO_2$—, —SO— or —CO—, and is more preferably —$SO_2$—.

In the formula (1), n represents 0 or 1, where 1 is more preferable.

$Z^1$ and $Z^2$ independently represent a halogen atom (e.g., fluorine, chlorine, bromine and iodine atoms), where it is preferable that both of $Z^1$ and $Z^2$ represent a bromine atom.

X represents a hydrogen atom or electron attractive group. The electron attractive group in the context of this specification means a substituent having a positive value for Hammett's substituent constant .P. Specific examples of such substituent include cyano group, alkoxycarbonyl group, aryloxycarbonyl group, carbamoyl group, sulfamoyl group, alkylsulfonyl group, arylsulfonyl group, halogen atom, acyl group and heterocyclic group. X more preferably represents a hydrogen atom or halogen atom, and most preferably a bromine atom.

While two or more compounds expressed by the formula (1) are preferably used in the present invention, at least one of which is preferably a compound having an electron attractive group for Q in the formula (1).

Possible examples of electron attractive group for Q include cyano group, alkoxycarbonyl group, aryloxycarbonyl group, carbamoyl group, imino group, N-substituted imino group, thiocarbonyl group, sulfamoyl group, alkylsulfonyl group, arylsulfonyl group, nitro group, halogen atom, perfluoroalkyl group, perfluoroalkanamide group, sulfonamide group, acyl group, formyl group, phosphoryl group, carboxyl group (or salt thereof), sulfo group (or salt thereof), heterocyclic group, alkenyl group, alkynyl group, acyloxy group, acylthio group, sulfonyloxy group, or aryl group substituted by these electron attractive groups.

Here, the heterocyclic group is defined as aromatic or non-aromatic, saturated or unsaturated heterocyclic group, which is typified as pyridyl group, quinolyl group, quinoxalinyl group, pyradinyl group, benzotriazolyl group, imidazolyl group, benzimidazolyl group, hydantoin-1-yl group, succinimido group and phthalimido group.

These electron attractive groups may further have a substituent, and examples thereof may be those exemplified for the alkyl group expressed by Q of the formula (1).

When Q in the formula (1) represents an electron attractive group, the electron attractive group preferably has a structure expressed by the formula (2).

When Q in the formula (1) is expressed by the formula (2), Q is preferably an arylene group, and more preferably a phenylene group. When Q represents a phenylene group, —$(Y)_1$—$C(Z^1)(Z^2)X$ and a group expressed by the formula (2) preferably bound to positions mutually in a meta relation.

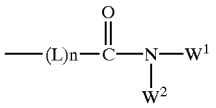

(2)

In the formula (2), L represents a linking group; $W^1$ and $W^2$ independently represent a hydrogen atom, alkyl group, aryl group or heterocyclic group; and n represents 0 or 1.

L in the formula (2) represents a bivalent linking group, and preferably an alkylene group (preferably of $C_{1-30}$, more preferably of $C_{1-20}$, and still more preferably of $C_{1-10}$) arylene group (preferably of $C_{6-30}$, more preferably of $C_{6-20}$, and still more preferably of $C_{6-10}$), alkenylene group (preferably of $C_{2-30}$, more preferably of $C_{2-20}$, and still more preferably of $C_{2-10}$), alkynylene group (preferably of $C_{2-30}$, more preferably of $C_{2-20}$, and still more preferably of $C_{2-10}$), bivalent heterocyclic group (preferably of $C_{1-30}$, more preferably of $C_{1-20}$, and still more preferably of $C_{1-10}$), —O— group, —NR— group (where R represents a hydrogen atom, alkyl group optionally substituted, or aryl group optionally substituted), —CO— group, —S— group, —SO— group, —$SO_2$— group, phosphorus-containing group, and a group composed of an arbitrary combination of these groups.

The linking group expressed by L in the formula (2) may have any substituent, and specific examples thereof may be those exemplified above for the arylene group expressed by Q.

The linking group expressed by L in the formula (2) is preferably an alkylene group, arylene group, —O— group, —NRCO— group, —$SO_2$NR— group or a group composed of an arbitrary combination thereof.

In the formula (2), n represents 0 or 1, where 0 is preferable.

$W^1$ and $W^2$ of the formula (2) independently represent a hydrogen atom, alkyl group, aryl group or heterocyclic group.

The alkyl group expressed by $W^1$ and $W^2$ of the formula (2) include straight-chained, branched or cyclic, substituted or unsubstituted alkyl group, and is preferably of $C_{1-20}$, more preferably of $C_{1-12}$, and still more preferably of $C_{1-6}$. Examples of such alkyl group include methyl, ethyl, n-propyl, isopropyl, n-butyl, sec-butyl, isobutyl, n-pentyl, sec-pentyl, isopentyl, 3-pentyl, n-hexyl, n-octyl, n-dodecyl and cyclohexyl groups.

The alkyl group expressed by $W^1$ or $W^2$ may have any substituent, and specific examples thereof may be those exemplified above for the arylene group expressed by Q. Examples of such substituent for the alkyl group expressed by $W^1$ or $W^2$ include halogen atom, alkenyl group, alkynyl group, aryl group, heterocyclic group, carbamoyl group, alkoxy group, aryloxy group, sulfonamide group, (alkyl or aryl)thio group, (alkyl or aryl)sulfonyl group, sulfo group or salt thereof, carboxyl group or salt thereof, phosphate group or salt there of and hydroxyl group; among these more preferable are halogen atom, alkenyl group, alkynyl group, aryl group, carbamoyl group, alkoxy group, aryloxy group, (alkyl or aryl)thio group, sulfo group or salt thereof, carboxyl group or salt thereof and hydroxyl group; and still more preferable are halogen atom, alkenyl group, carbamoyl group, alkoxy group, alkylthio group, salt of sulfo group, carboxyl group or salt thereof and hydroxyl group.

The aryl group expressed by $W^1$ or $W^2$ in the formula (2) has a monocyclic or condensed ring structure, and is preferably of $C_{6-20}$, more preferably of $C_{6-16}$, and still more preferably of $C_{6-10}$. Typical examples thereof include phenyl group and naphthyl group, where phenyl group is more preferable. The aryl group expressed by $W^1$ or $W^2$ may have any substituent, where specific examples thereof may be those exemplified above for the alkyl group expressed by $W^1$ or $W^2$, and also the preferable range is the same.

The heterocyclic group expressed by $W^1$ or $W^2$ in the formula (2) has five- to seven-membered, saturated or unsaturated hetero ring containing at least one of nitrogen, oxygen and sulfur atoms, which may be a monocycle or condensed with other ring(s). Examples thereof include pyridyl, pyradinyl, pyrimidinyl, thiazolyl, imidazolyl, benzothiazolyl, benzimidazolyl, thiadiazolyl, guinolyl, isoquinolyl and triazolyl groups. These heterocyclic groups may have any substituents, where specific examples thereof may be those exemplified above for the alkyl group expressed by $W^1$ or $W^2$, and also the preferable range is the same.

$W^1$ and $W^2$ in the formula (2) may be the same or may differ with each other, or may bind with each other to form a cyclic structure.

$W^1$ and $W^2$ in the formula (2) preferably represent a hydrogen atom, alkyl group or aryl group, and in particular hydrogen atom or alkyl group.

Specific examples of the compound expressed by the formula (1) will be enumerated below, while being not limited thereto.

Compounds express by the formula (1) (polyhalogen compounds) can be exemplified as those described, for example, in U.S. Pat. Nos. 3,874,946, 4,756,999, 5,340,712, 5,369,000, 5,464,737, JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, JP-A-2000-2963, JP-A-2000-112070, Japanese Patent Application Nos. 11-90095, 11-89773 and 11-205330.

An amount of use of the compound expressed by the formula (1) is preferably $1\times10^{-6}$ to $1\times10^{-2}$ mol/m$^2$ as expressed by a coated amount per square meters of the photothermographic material, more preferably $1\times10^{-5}$ to $5\times10^{-3}$ mol/m$^2$, and still more preferably $2\times10^{-5}$ to $1\times10^{-3}$ mol/m$^2$.

The compound expressed by the formula (1) can be added to any layer provided on the same side with the image producing layer as viewed from a support, that is to the image producing layer and the layer on the same side therewith, where addition to the image producing layer or to the layer adjacent thereto is preferable.

The compound expressed by the formula (1) can be used as dissolved in water or other appropriate organic solvents such as alcohols (methanol, ethanol, propanol, fluorinated alcohol), ketones (acetone, methyl ethyl ketone, methyl isobutyl ketone), dimethylformamide, dimethylsulfoxide and Methyl Cellosolve. The compound can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powder of such compound is dispersed into water with the aid of a ball mill, colloid mill, sand grinder mill, Mantone galling, micro-fluidizer or ultrasonic. wave.

The high-speed photothermographic material of the present invention contains. elsewhere on a support a non-photosensitive organic acid silver salt, a photosensitive silver halide, a nucleation aid, a binder and at least one compound expressed by the formula (A) and two or more compounds as expressed by the formula (1). The "high-speed photothermographic material" in the context of this specification refers to a photosensitive material which can be heat-developed at a line speed of 140 cm/min or faster. Heat development of the conventional photothermographic material at such fast line speed only resulted in a significant widening of character line width and in fogging. On the contrary, the high-speed photothermographic material having the foregoing features allows a high dimensional stability in character line width, and can provide a quality image with low fog ($D_{min}$) and a high maximum density ($D_{max}$). The high-speed photothermographic material of the present invention is preferably heat-developed particularly at a line speed of 140 to 1,000 cm/min.

The photothermographic material of the present invention contain a non-photosensitive silver salt. An organic acid silver salt is now preferable as the non-photosensitive silver salt.

The organic acid silver salt used in the present invention is relatively stable against light exposure but can produce silver image when heated at 80. C. or higher in the presence of light-exposed photocatalyst (e.g., latent image produced by photosensitive silver halide) and reducing agent. The organic acid silver salt may be an arbitrary organic substance containing a reducible silver ion source. Organic acid silver salt, in particular, silver salt of long-chained aliphatic carboxylic acid (with a carbon number of 10 to 30, and preferably 15 to 28) is preferred. Complex of organic or inorganic acid silver salt, whose ligand has a complex stability constant of from 4.0 to 10.0, is also preferred. The silver source substance may preferably account for approx. 5 to 70 wt % of the image producing layer. Preferable organic acid silver salt includes silver salt of organic compound having carboxyl group. Specific examples thereof include silver salts of aliphatic carboxylic acid and aromatic carboxylic acid, while being not limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Among these organic acid silver salts or mixtures thereof, it is preferable to use an organic acid silver salt having a silver behenate content of 75 mol % or more, and more preferably 85 mol % or more. The silver behenate content described herein refers to a molar fraction of silver behenate in the total organic acid silver salts employed. The organic acid silver salts other than silver behenate can preferably be selected from those listed above.

The organic acid silver salt preferably used in the present invention can be prepared by reacting silver nitrate with a solution or suspension of an alkali metal salt (sodium salt, potassium salt, lithium salt or the like) of the organic acid listed above, A method disclosed in the paragraphs [0019] to [0021] of Japanese Patent Application No. 11-104187 will be a good reference for such preparation.

The organic acid silver salt for use in the present invention can be prepared by reacting a solution or suspension of an alkali metal salt (exemplified as sodium salt, potassium salt and lithium salt) of the above-described organic acid with silver nitrate. The alkali metal salt of the organic acid is obtained by alkali treatment of the above-described organic acid. The organic acid silver salt for use in the present invention can be prepared in an arbitrary proper vessel in a batch or continuous manner. Stirring in the reaction vessel may be effected with an arbitrary stirring method according to target properties of the grains. Preferable methods applicable for preparing the organic acid silver salt include such that adding gradually or abruptly an aqueous silver nitrate solution into a reaction vessel containing a solution or suspension of the alkali metal salt of the organic acid; such that adding gradually or abruptly a previously prepared solution or suspension of the alkali metal salt of the organic acid into a reaction vessel containing an aqueous silver nitrate solution; and such that pouring at a time into a reaction vessel an aqueous silver nitrate solution and a solution or suspension of the alkali metal salt of the organic acid, both of which being previously prepared.

The aqueous silver nitrate solution, and solution or suspension of the alkali metal salt of the organic acid may be of an arbitrary concentration and may be added at an arbitrary rate of addition to control the grain size of the organic acid silver salt to be prepared. The addition of the aqueous silver nitrate solution, or solution as well as suspension of the alkali metal salt of the organic acid may be effected at a constant addition rate, or accelerated or decelerated addition rate according to an arbitrary time-related function. Either addition onto the surface of the solution or deep into the solution are allowable. When an aqueous silver nitrate solution and a solution or suspension of the alkali metal salt of the organic salt, both being previously prepared, are poured at a time into a reaction vessel, either the aqueous silver nitrate solution, or the solution or suspension of the alkali metal salt of the organic acid may precedently be poured, where the aqueous silver nitrate solution is preferably poured in a preceding manner. A degree of the precedence may preferably be 0 to 50 vol % of the total addition, and more preferably 0 to 25 vol %. It is also preferable as disclosed in JP-A-9-127643 to add the solution while controlling pH or silver potential of the reaction solution during the reaction.

The aqueous silver nitrate solution, or the solution or suspension of the alkali metal salt of the organic acid may have pH thereof adjusted according to target properties of the resultant grains. An arbitrary acid or alkali can be added for the pH control. Temperature of the content in the reaction vessel can arbitrarily be set according to the required characteristics, and for example to control the grain size, of the organic acid silver salt, and the same will apply to the aqueous silver nitrate solution to be added, or the solution or suspension of the alkali metal salt of the organic acid to be added. The solution or suspension of the alkali metal salt of the organic acid is preferably kept by heating at 50° C. or above to ensure a proper fluidity thereof.

In the present invention, a preferable method for preparing the organic acid silver salt relates to adding an aqueous silver nitrate solution and a solution of an organic acid alkali metal salt into a closed liquid mixing means. A method disclosed in Japanese Patent Application No. 11-203413 will be a good reference for such preparation.

In the preparation of the organic acid silver salt in the present invention, it is allowable to add a water-soluble dispersion aid to the aqueous silver nitrate solution, the solution of organic acid alkali metal salt or the reaction mixture. Specific examples of species and amount of use of the dispersion aid are described in the paragraph [0052] of Japanese Patent Application No. 11-115457.

The organic acid silver salt for use in the present invention is preferably prepared in the presence of a tertiary alcohol. The tertiary alcohol used in the present invention preferably has a total carbon number of 15 or below, and more preferably 10 or below. A preferable example of such tertiary alcohol relates to t-butanol, while being not limited thereto.

While the tertiary alcohol used in the present invention may be added at any timing during the preparation of the organic acid silver salt, it is preferable to add the alcohol at the time of preparation of the alkali metal salt of the organic acid and to use the alkali metal salt of the organic acid in a dissolved state. An amount of addition of the tertiary alcohol may be set at an arbitrary ratio by weight within a range from 0.01 to 10 relative to water as a solvent used for preparing the organic acid silver salt, and preferably from 0.03 to 1.

While there is no specific limitation on the shape or size of the organic acid silver salt grains, such that described in the paragraph [0024] of Japanese Patent Application No. 11-104187 is preferable. The shape of the organic acid silver salt can be determined based on the image of organic acid silver salt dispersion observed with a transmission electron microscope. Another method for determining the monodispersibility is such that obtaining the standard deviation of volume weighted mean diameter of the organic acid silver salt. The percentage (coefficient of variation) of the value obtained by dividing the standard deviation of the volume weighted mean diameter by such volume weighted mean diameter is preferably 80% or less, more preferably 50% or less, and still more preferably 30% or less. The measurement procedures include irradiating laser light to the organic acid silver salt dispersed in a solution; deriving an autocorrelation function with respect to. the time-dependent fluctuation in the scattered light intensity; and thereby obtaining grain size (volume weighted mean diameter). An average grain size of a solid grain dispersion determined by such method is preferably 0.05 to 10.0 $\mu$m, more preferably 0.1 to 5.0 $\mu$m, and still more preferably 0.1 to 2.0 $\mu$m.

The organic acid silver salt grains for use in the present invention is preferably desalted. Methods for desalting are not limitative and any known method is permissible, where centrifugal filtration, suction filtration, ultrafiltration, and flocculation washing based on coagulation are preferable. Ultrafiltration can be conducted according to the description in Japanese Patent Application No. 11-115457.

To obtain a solid grain dispersion of the organic acid silver salt with a small grain size and no coagulation and allowing a high S/N ratio, it is preferable in the present invention to first prepare a water-base dispersion containing the organic acid silver salt as an image producing medium but substantially no photosensitive silver salt, convert the dispersion into a high-speed flow, and then drop the pressure to effect dispersion. Such dispersion methods are disclosed in the paragraphs [0027] to [0038] of Japanese Patent Application No. 11-104187.

The grain size distribution of the solid micrograin dispersion of the organic acid silver salt for use in the present invention is preferably monodisperse. More specifically, the percentage (coefficient of variation) of the value obtained by dividing the standard deviation of the volume weighted mean diameter by such volume weighted mean diameter is preferably 80% or less, more preferably 50% or less, and still more preferably 30% or less.

The solid grain dispersion of the organic acid silver salt for use in the present invention comprises at least the organic acid silver salt and water. While there is no specific limitation on the ratio of the organic acid silver salt and water, the organic acid silver salt preferably accounts for 5 to 50 wt % of the whole dispersion, and more preferably 10 to 30 wt %. Using the above-described dispersion aid is preferable provided that it is used in a minimum amount within a range suitable for minimizing the grain size, and preferable range thereof is 0.5 to 30 wt % relative to the organic acid silver salt, and more preferably 1 to 15 wt %.

While the organic acid silver salt may be used in a desired amount in the present invention, a preferable range resides in 0.1 to 5 g/m$^2$ as an silver amount, and more preferably 1 to 3 g/m$^2$.

In the present invention, it is preferable to add a metal ion selected from the group consisting of Ca, Mg, Zn and Ag to the non-photosensitive organic acid silver salt. Such metal ion selected from the group consisting of Ca, Mg, Zn and Ag is preferably added to the non-photosensitive organic acid silver salt in a form of a water-soluble metal salt rather than halide, and more specifically, in a form of nitrate or sulfate. The addition in a form of halide is undesirable since it may degrade the image storability against light exposure (room light or sun ray), which is referred as so-called print-out property. Hence the addition in a form of a water-soluble metal salt rather than a halide is preferable in the present invention.

The metal ion selected from the group consisting of Ca, Mg, Zn and Ag can be added at any timing provided that it is effected after the formation of the non-photosensitive organic acid silver salt grains and immediately before the coating; such as immediately after the grain formation of the non-photosensitive organic acid silver salt grains, before or after the dispersion, or before or after the preparation of the coating liquid. The addition after the dispersion, and the addition before or after the preparation of the coating liquid are preferable.

An amount addition of the metal selected from the group consisting of Ca, Mg, Zn and Ag is preferably $10^{-3}$ to $10^{-1}$ mol per mol of the non-photosensitive organic acid silver salt, and more preferably $5\times10^{-3}$ to $5\times10^{-2}$ mol.

There is no specific limitation on the halogen composition of the photosensitive silver halide for use in the present invention, and examples of which include silver chloride, silver chlorobromide, silver bromide, silver iodobromide and silver iodochlorobromide. The grain formation of the photosensitive silver halide emulsion is described in the paragraphs [0217] to [0224] of JP-A-11-119374, while being not limited thereto.

Possible shapes of the silver halide grains include cube, octahedron, tetradecahedron, tabular, sphere, rod and pebble. Cubic grains and tabular grains are particularly preferable in the present invention. Morphological characteristics of the grain, such as aspect ratio and plane index, are similar to those disclosed in the paragraph [0225] of JP-A-11-119374. The halogen composition distribution within the grain may be uniform, or the halogen composition may vary stepwisely or continuously. Silver halide grain with a core/shell structure may preferably be used, in which the structure thereof is preferably of double to quintiple, and more preferably of double to quadruple. It is also preferable to adopt a technique for localizing silver bromide on the surface of silver chloride grain or silver cholorobromide grain.

The grain size distribution of the silver halide grains for use in the present invention is expressed with a monodispersibility of 30% or below, more preferably 1 to 20%, and still more preferably 5 to 15%. The monodispersibility described herein is defined as a value obtained by dividing the standard deviation of the grain diameter by the volume weighted mean diameter and expressed in percentage (%: coefficient of variation). The grain diameter of the silver halide grains is now represented by length of edge for the cubic grain, and by a projected circle-equivalent diameter for other grains (e.g., octahedral, tetradecahedral and tabular grains).

The photosensitive silver halide grains for use in the present invention contain a Group VII or Group VIII metal in the Periodic Table, or a complex of such metal. The Group VII or Group VIII metal in the Periodic Table, or a center metal of the metal complex is preferably rhodium, rhenium, ruthenium, osmium or iridium. Particularly preferable metal complexes include $(NH_4)_3Rh(H_2O)Cl_5$, $K_2Ru(NO)Cl_5$, $K_3IrCl_6$ and $K_4Fe(CN)_6$. These metal complexes may be used individually, or in combination of two or more complexes of the same metal or different metals. The metal complex content is preferably from $1\cdot10^{-9}$ to $1\cdot10^{-3}$ mol per mol of silver, and more preferably from $1\cdot10^{-8}$ to $1\cdot10^{-4}$ mol. Specific examples of the available metal complexes relate to those having the structures described in JP-A-7-225449. Species and addition methods of these heavy metals are disclosed in the paragraphs [0227] to [0240] of JP-A-11-119374.

The photosensitive silver halide grains may be desalted by water washing according to a method known in the art, such as noodle washing and flocculation, while omission of the desalting being also allowable in the present invention.

It is preferable that the photosensitive silver halide emulsion for use in the present invention is chemically sensitized. The chemical sensitization can be effected according to the method described in the paragraphs [0242] to [0250] of JP-A-11-119374.

The silver halide emulsion for use in the present invention is preferably added with a thiosulfonic acid compound according to a method described in European Patent No. 293,917.

The gelatin contained in the photosensitive silver halide for use in the present invention is preferably a low-molecular-weight gelatin so as to maintain a desirable dispersion state of the photosensitive silver halide emulsion in the coating liquid of the organic acid silver salt grains. The molecular weight of the low-molecular-weight gelatin is within a range from 500 to 60,000, and more preferably from 1,000 to 40,000. The low-molecular-weight gelatin may be used during the grain formation or during the dispersion after desalting, where the latter being more preferable. It is also allowable to use a general gelatin (molecular weight of approx. 100,000) during the grain formation and use a low-molecular-weight gelatin during the dispersion after desalting.

The concentration of the dispersion medium is preferably 0.05 to 20 wt %, and more preferably 5 to 15 wt % from the viewpoint of handling property. Besides generally used alkali-treated gelatin, available are modified gelatins such as acid-treated gelatin and phthalized gelatin.

In the photosensitive material used for the present invention, a single kind of silver halide emulsion may be used, or two or more kinds of silver halide emulsions (for example, those differ in the average grain size, halogen composition, crystal habit or chemical sensitization conditions) may be used in combination.

An amount of the photosensitive silver halide used in the present invention is preferably from 0.01 to 0.5 mol per mol of the organic acid silver salt, more preferably from 0.02 to 0.3 mol, still more preferably from 0.03 to 0.25 mol. Methods for mixing photosensitive silver halide and organic acid silver salt separately prepared include such that mixing, after completion of the individual preparation, the silver halide grains and the organic acid silver salt in a high-speed stirrer, ball mill, sand mill, colloid mill, vibrating mill, homogenizer or the like; and such that mixing, at any timing during the preparation of the organic acid silver salt, already-finished photosensitive silver halide to prepare the organic acid silver salt; while being not limited thereto so long as sufficient effects of the present invention are obtained. Mixing two or more aqueous dispersions of the organic acid silver salts and two or more aqueous dispersions of the photosensitive silver salts is preferable to control the photographic properties.

The photothermographic material of the present invention can be added with a sensitization dye. The sensitization dye available in the present invention is such that being capable of spectrally sensitizing silver halide grains within a predetermined wavelength range upon adsorbing on such silver halide grains. It is advantageous to select a sensitization dye having a spectral sensitivity well matched to the spectral characteristic of an exposure light source to be used. For example, a dye showing spectral sensitization in a range from 550 to 750 nm is expressed by the general formula (II) of JP-A-10-186572, and is enumerated as Compounds II-6, II-7, II-14, II-15, II-18, II-23 and II-25. Another dye showing spectral sensitization in a range from 750 to 1400 nm is expressed by the general formula (I) of JP-A-11-119374, and is enumerated as Compounds (25), (26), (30), (32), (36), (37), (41), (49) and (54). Dyes forming J-band have been disclosed in U.S. Pat. Nos. 5,510,236 and 3,871,887 (Example 5), JP-A-2-96131 and JP-A-59-48753. These dyes may be used individually or in combination of two or more thereof.

A method of addition of the sensitization dye can be found in the paragraph [0106] of JP-A-11-119374, while being not limited thereto.

An amount of addition of the sensitization dye used in the present invention may be selected according to the performance such as sensitivity or fog; where it is preferably from $10^{-6}$ to 1 mol per mol of silver halide in the photosensitive layer, and more preferably from $10^{-4}$ to $10^{-1}$ mol.

In the photothermographic material of the present invention, a supersensitizer can be used for improving spectral sensitization efficiency. Examples of the supersensitizer available in the present invention include compounds disclosed in European Patent No. 587,338, U.S. Pat. Nos. 3,877,943 and 4,873,184; heteroaromatic or aliphatic mercapto compounds; heteroaromatic disulfide compounds; stilbene, hydrazine and triazine.

Particularly preferable supersensitizers include a heteroaromatic mercapto compound disclosed in JP-A-5-341432; heteroaromatic disulfide compounds; compounds expressed by the general formula (I) and (II) of JP-A-4-182639; stilbene compounds expressed by the general formula (I) of JP-A-10-111543; and compounds expressed by the general formula (I) of JP-A-11-109547. More specifically, they include Compounds M-1 to M-24 of JP-A-5-341432; Compounds d-1) to d-14) of JP-A-4-182639; Compounds SS-01 to SS-07 of JP-A-10-111543; and Compounds 31, 32, 37, 38, 41 to 45, and 51 to 53 of JP-A-11-109547.

The amount of addition of such supersensitizer is preferably $10^{-4}$ to 1 mol per mol of silver halide in the emulsion layer, and more preferably 0.001 to 0.3 mol.

Next, the nucleation aid used for the photothermographic material will be described.

While there is no specific limitation on the species of the nucleation aid, preferable is a hydrazine derivative expressed by the general formula (H) of Japanese Patent Application No. 11-87297 (more specifically hydrazine derivatives listed in Tables 1 to 4 in the same specification), and any hydrazine derivative disclosed in JP-A-10-10672, JP-A-10-161270, JP-A-10-62898, JP-A-9-304870, JP-A-9-304872, JP-A-9-304871, JP-A-10-31282, U.S. Pat. No. 5,496,695 and European Patent No. 741,320.

Other examples include substituted alkene derivatives, substituted isooxazole derivatives and specific acetal compound expressed by the general formulae (1) to (3) of JP-A-11-87297, more preferably cyclic compounds expressed by the formulae (A) and (B) of the same specification, and still more specifically Compounds 1 to 72 expressed by the formulae (8) to (12) of the same specification These nucleation aids may be used in combination of two or more thereof.

The foregoing nucleation aid can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The nucleation aid can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powder of the nucleation aid is dispersed into water with aid of a ball mill, colloid mill or ultrasonic wave, The nucleation aid can be added to any layer provided on the same side with the image producing layer as viewed from a support, where addition to the image producing layer or to the layer adjacent thereto is preferable.

The nucleation aid is preferably used in an amount from $1\times10^{-6}$ to 1 mol per mol of silver, and more preferably from $1\times10^{-5}$ to $5\times10^{-1}$ mol, and still more preferably from $2\times10^{-5}$ to $2\times10^{-1}$ mol.

Besides the compounds listed above, it is also allowable to use the compounds disclosed in U.S. Pat. Nos. 5,545,515, 5,635,339, 5,654,130, International Patent Publication WO 97/34196, U.S. Pat. No. 5,686,228, JP-A-11-119372, JP-A-11-133546, JP-A-11-119373, JP-A-11-109546, JP-A-11-95365, JP-A-11-95366 and JP-A-11-149136.

In the present invention, a contrast accelerator may be used in combination with the above-described nucleation aid so as to produce an ultrahigh contrast image. Examples thereof include amine compounds described in U.S. Pat. No. 5,545,505, specifically, Compounds AM-1 to AM-5; hydroxamic acids described in U.S. Pat. No. 5,545,507, specifically, Compounds HA-1 to HA-11; acrylonitriles described in U.S. Pat. No. 5,545,507, specifically, Compounds CN-1 to CN-13; hydrazine compounds described in U.S. Pat. No. 5,558,983, specifically, Compounds CA-1 to CA-6; and onium salts described in JP-A-9-297368, specifically, compounds A-1 to A-42, B-1 to B-27 and C-1 to C-14.

Formic acid or formate can act as a strong foggant in the photothermographic material containing a non-photosensitive organic acid silver salt, a photosensitive silver halide and a binder. Thus in the present invention, the content of formic acid or formate in any layer on the same side with the image producing layer containing the photosensitive silver halide is preferably 5 mmol or below per mol of silver, and more preferably 1 mmol or below.

For the photothermographic material, it is preferable to use, in combined with the nucleation aid, an acid produced by hydration of phosphorus pentoxide or a salt thereof. An acid produced by hydration of phosphorus pentoxide or a salt thereof include metaphosphoric acid (metaphosphate), pyrophosphoric acid (pyrophosphate), orthophosphoric acid (orthophosphate), triphosphoric acid (triphosphate), tetraphosphoric acid (tetraphosphate), and hexametaphosphoric acid (hexametaphosphate); among which orthophosphoric acid (orthophosphate) and hexametaphosphoric acid (hexametaphosphate) being more preferable. The salts are specified as sodium orthophosphate, sodium dihydrogenorthophosphate, sodium hexametaphosphate and ammonium hexametaphosphate.

An acid produced by hydration of phosphorus pentoxide or a salt thereof preferably used in the present invention is added to the image producing layer or the adjacent binder-containing layer in terms of exhibiting a desired effect in a minimum amount of use.

While an amount of use (an amount of coating per me of the photosensitive material) of an acid produced by hydration of phosphorus pentoxide or a salt thereof can be a desired amount considering the properties such as sensitivity and fog, a preferable amount resides in a range from 0.1 to 500 mg/$^2$, and more preferably 0.5 to 100 mg/m$^2$.

The photothermographic material of the present invention preferably contains a reducing agent for reducing the organic acid silver salt. Such reducing agent may be an arbitrary substance capable of reducing silver ion into metal silver, and preferably an organic substance. While conventional photographic developers such as phenidone, hydroquinone and catechol are useful, a hindered phenol reducing agent is preferred. The reducing agent is preferably contained in an amount of from 5 to 50 mol % per mol of silver contained elsewhere on the side having the image producing layer, and more preferably from 10 to 40 mol %. A layer to which the reducing agent is added may be any layer on the same side with the image producing layer as viewed from the substrate. In the case of adding the reducing agent to a layer other than the image producing layer, the reducing agent is preferably used in a slightly larger amount of from 10 to 50 mol % per mol of silver. The reducing agent may also be a so-called precursor which is derived to effectively exhibit its function only at the time of development.

For photothermographic material using an organic acid silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, P-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328 and European Patent No. 692,732. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl) propionyl-.-phenylhydrazine with ascorbic acid; combinations of polyhydroxybenzene with hydroxylamine, reductone and/or hydrazine (e.g., combination of hydroquinone with bis (ethoxyethyl)hydroxylamine, piperidinohexose reductone or formyl-4-methylphenylhydrazine; hydroxamic acids such as phenylhydroxamic acid, p-hydroxyphenylhydroxamic acid and .-anilinehydroxamic acid; combinations of azine with sulfonamidophenol such as a combination of phenothiazine with 2,6-dichloro-4-benzenesulfonamidophenol; .-cyanophenylacetic acid derivatives such as ethyl-.-cyano-2-methylphenyl acetate and ethyl-.-cyanophenyl acetate; bis-.-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of bis-.-naphthol with 1,3-dihydroxybenzene derivative (e.g., 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-tert-butyl-5-methylphenyl)methane, 2,2-bis(4-hydroxy-3-methylphenyl) propane, 4,4-ethylidene-bis(2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols (e.g. tocopherol). Particularly preferred reducing agents are bisphenols and chromanols.

The reducing agent used in the present invention may be added in any form of aqueous solution, organic solvent solution, powder, solid micrograin dispersion or emulsified dispersion. Dispersion of the solid micrograin is effected using a known pulverizing means. (e.g., ball mill, vibrating ball mill, sand mill, colloid mill, jet mill and roller mill). A dispersion aid may be available for dispersing the solid micrograin.

Adding an additive known as a toning agent to the photothermographic material may sometimes raise the optical density. In some cases the toning agent is even advantageous in forming a black silver image. The toning agent is preferably contained in elsewhere on the side having the image forming layer in an amount of 0.1 to 50 mol % per mol of silver, and more preferably 0.5 to 20 mol %. The toning agent may also be a so-called precursor which is derived to effectively exhibit its function only at the time of development.

For use in the photothermographic material using the organic acid silver salt, a wide variety of the toning agents are disclosed, for example, in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727 (the code "JP-B" as used herein means an "examined Japanese Patent Publication"), JP-B-54-20333, U.S. Pat. Nos. 3,080,254, 3,446,648, 3,782,941, 4,123,282 and 4,510,236, British Patent No. 1,380,795and Belgian Patent No. 841,910. Examples of the toning agent include phthalimide and N-hydroxyphthalimide; cyclic imides such as succinimide, pyrazoline-5-one, quinazolinone, 3-phenyl-2-pyrazoline-5-one, 1-phenylurazole, quinazoline and 2,4-thiazolinedione; naphthalimide (e.g., N-hydroxyl-1,8-naphthalimide); cobalt complex (e.g., cobalthexamine trifluoroacetate); mercaptans such as 3-mercapto-1,2,4-triazole, 2,4-dimercapto-pyrimidine, 3-mercapto-4,5-diphenyl-1,2,4-triazole and 2,5-dimercapto-1,3,4-thiadiazole; N-(aminomethyl) aryldicarboxyimide [e.g., N,N-(dimethylaminomethyl)phthalimide and N,N-(dimethylaminomethyl)naphthalene-2,3-dicarboxyimide]; blocked pyrazole, isothiuronium derivatives and a certain kind of photofading agent [e.g., N,N'-hexamethylenebis(1-carbamoyl-3,5-dimethylpyrazole), 1,8-(3,6-diazaoctane)bis(isothiuronium trifluoroacetate) and 2-tribromomethylsulfonyl)benzothiazole]; 3-ethyl-5-[(3-ethyl-2-benzothiazolinilidene)-1-methylethylidene]-2-thio-2,4-oxazolidinedione; phthalazinone, phthalazinone derivatives or metal salts, or the derivatives such as 4-(1-naphthyl) phthalazinone, 6-chlorophthalazinone, 5,7dimethoxy-phthalazinone or 2,3-dihydro-1,4-phthalazinedione; combinations of phthalazinone and phthalic acid derivatives [e.g., phthalic acid, 4-methyltphthalic acid, 4-nitrophthalic acid and tetrachlorophthalic anhydride); phthalazines, phthalazine derivatives (e.g., 4-(1-naphthyl)phthalazine, 6-chlorophthalazine, 5,7-dithoxyphthalazine, 6-isobutylphthalazine, 6-tert-butylphthalazine, 5,7-dimethylphthalazine and 2,3-dihydrophthalazine] or metal salts; combinations of phthalazine and phthalic acid derivatives [e.g., phthalic acid, 4-methyltphthalic acid, 4-nitrophthalic acid and tetrachlorophthalic anhydride); quinazolinedione, benzoxazine or natphthoxazine derivatives; rhodium complex serves, not only as a toning agent, but also as an in situ halide ion source for producing silver halide, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazine (e.g., 2,4-dihydroxypyrimidine and 2-hydroxy-4-aminopyrimidine); azauracil; and tetraazapentalene derivatives (e.g., 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene).

In the present invention, a phthalazine derivative expressed by the general formula (F) of JP-A-2000-35631 is preferably used as a toning agent. Preferable examples are specified as Compounds A-1 to A-10 in the same specification.

The toning agent may be added in any form of solution, powder or solid micrograin dispersion. Dispersion of the solid micrograin is effected using a known pulverizing means (e.g., ball mill, vibrating ball mill, sand mill, colloid mill, jet mill and roller mill). A dispersion aid may be available for dispersing the solid micrograin.

The pH of the surface of the photothermographic material of the present invention is preferably adjusted to 6.0 or below before the heat development, and more preferably 5.5 or below. The lower limit is set at approx. pH 3, while being not limited thereto An organic acid such as phthalic acid, non-volatile acid such as sulfuric acid, or volatile base such as ammonia is preferably used to lower the surface pH. Ammonia is particularly preferable to attain a low surface pH since it is highly volatile and can easily be removed in the coating process or before heat development process. A method for measuring pH is disclosed in the paragraph [0123] of Japanese Patent Application No. 11-87297.

In the photothermographic material, the silver halide emulsion and/or organic acid silver salt can successfully be prevented, by addition of antifoggant, stabilizer or stabilizer precursor, from additional fogging and from lowered sensitivity during the stock storage. Appropriate examples of antifoggant, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

The photothermographic material of the present invention may contain benzoic acids for improving the sensitivity and for preventing fog. Any kind of benzoic acid derivatives are available for the present invention, where preferred examples of the structure include those described in U.S. Pat. Nos. 4,784,93 9 and 4,152,160 and JP-A-9-329863, JP-A-9-329864 and JP-A-9-281637. Although the benzoic acid for use in the present invention may be added to any portion of the photosensitive material, addition to a layer provided on the same side with the image producing layer is preferable, and to a layer containing the organic acid silver salt is more preferable. The benzoic acids may be added atany step during the preparation of the coating liquid. In the case of addition to the layer containing the organic acid silver salt, the benzoic acids may be added at any step within a period from the preparation of the organic acid silver salt to the preparation of the coating liquid, where addition in a period following the preparation of the organic acid silver salt and immediately before the coating is preferable. The benzoic acids may be added in any form of solution, powder or solid micrograin dispersion. It is also allowable to add the benzoic acids in a form of solution also containing other additives such as a sensitizing dye, reducing agent and toning agent. An amount of addition of the benzoic acids can arbitrarily be selected, where a preferable range being from $1\times10^{-6}$ to 2 mol per mol of silver, and more preferably from $1\times10^{-3}$ to 0.5 mol.

While being not essential in embodying the present invention, it is advantageous in some cases to add a mercury (II) salt as an antifoggant to the emulsion layer. Preferred mercury(II) salts for this purpose are mercury acetate and mercury bromide. An amount of addition of mercury for use in the present invention is preferably from $1\times10^{-9}$ to $1\times10^{-3}$ per mol of silver coated, and more preferably from $1\times10^{-8}$ to $1\times10^{-4}$ mol.

An antifoggant which is most preferably used in the present invention is organic halide, and the typical examples thereof are disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

An example of the preferable antifoggant is typically disclosed as hydrophilic organic halides as expressed by the general formula (P) of Japanese Patent Application No. 11-87297, specific examples thereof being Compounds (P-1) to (P-118) listed in the same specification.

An amount of addition of the organic halide, as expressed in a molar amount per mol of silver (mol/mol Ag), is preferably $1\times10^{-5}$ to 2 mol/mol Ag, more preferably $5\times10^{-5}$ to 1 mol/mol Ag, and still more preferably $1\times10^{-4}$ to $5\times10^{-1}$ mol/mol Ag. These compounds may be used individually, or in combination of two or more species.

Salicylic acid derivatives expressed by the general formula (Z) of Japanese Patent Application No. 11-87297 are also a preferable antifoggant, which are specified as Compounds (A-1) to (A-60) in the same specification. An amount of addition of the salicylic acid derivative expressed by the general formula (Z), as expressed in a molar amount per mol of silver (mol/mol Ag), is preferably $1\times10^{-5}$ to $5\times^{10-1}$ mol/mol Ag, more preferably $5\times10^{-5}$ to $1\times10^{-1}$ mol/mol Ag, and still more preferably $1\times10^{-4}$ to $5\times10^{-2}$ mol/mol Ag. These compounds may be used individually, or in combination of two or more species.

Formalin scavengers are an effective antifoggant for use in the present invention. They are typically expressed by the formula (S) of Japanese Patent Application No. 11-23995 and are specified as Compounds (S-1) to (S-24).

The antifoggant for use in the present invention can be used as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The antifoggant can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, mantone galling, microfluidizer or ultrasonic wave.

The antifoggant can be added to the image producing layer or any other layer provided on the same side therewith as viewed from a support, where addition to the image producing layer or the adjacent layer is preferable. The image producing layer refers to a layer containing a reducible silver salt (organic acid silver salt), and more preferably to a layer further containing a photosensitive silver halide.

The photothermographic material of the present invention may contain mercapto compound, disulfide compound or thione compound so as to control the development by inhibiting or accelerating thereof, or to improve the storage stability before and after the development.

While any structure of mercapto compound may be available in the present invention, such that expressed by Ar—SM or Ar—S—S—Ar is preferable, wherein M represents a hydrogen atom or alkali metal atom; and Ar represents a heteroaromatic ring or condensed heteroaromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxyl, amino, carboxyl, alkyl (of $C_1$ or larger, preferably of $C_{1-4}$, for example), alkoxy (of $C_1$ or larger, preferably of $C_{1-4}$, for example) and aryl (which may also be substituted). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis (benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate; N-methyl-N'-[3-(5-mercaptotetrazolyl)phenyl]urea, and 2-mercapto-4-phenyloxazole, while being not particularly limited thereto.

An amount of the addition of the mercapto compounds, as expressed in an amount per mol of silver in the image producing layer, is preferably from 0.0001 to 1.0 mol per one mol of silver, and more preferably from 0.001 to 0.3 mol.

The photothermographic material of the present invention has on a support an image producing layer containing a non-photosensitive organic acid silver salt, a reducing agent and a photosensitive silver halide, where it is preferable that at least one protective layer is provided on the image producing layer. It is also preferable that the photothermographic material of the present invention has at least one back layer on the other side of the support and opposite to the image producing layer. Polymer latex is used as a binder for the image producing layer, protective layer and back layer. Using the polymer latex for such layers allows water-base coating using a solvent (dispersion medium) containing water as a major component, which is advantageous from environmental and economical viewpoints and in obtaining a photothermographic material causing no corrugation during the heat development using a support preliminarily subjected to a predetermined heat processing will yield a photothermographic material less in dimensional changes before and after the heat development.

As for the binder for use in the present invention, polymer latex described hereinafter is preferably used.

In the photothermographic material of the present invention, at least one of image producing layer containing the photosensitive silver halide is preferably an image producing layer in which a polymer latex accounts for 50 wt % or more of the total binder. The water-dispersed thermoplastic resin can be used not only for the image producing layer, but also for the protective layer and back layer, and can successfully be applied to printing where dimensional variation raises a critical issue. Now, the "polymer latex" in the context of this specification is defined as a water-insoluble hydrophobic polymer being dispersed as fine particles in a water-soluble dispersion medium. The dispersion may have any form of polymer emulsified in dispersion medium, emulsion-polymerized or dispersed as micells; or the polymer can be dispersed so that its molecular chain per se disperses when the polymer has, in a part of its body, some hydrophilic structure. Details for such polymer latex available in the present invention are found, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average particle size of 1 to 50,000 nm, more preferably approx. 5 to 1,000 nm. The particle size distribution of the dispersed particles is not particularly limited, and the dispersed particles may have a broad grain size distribution or a monodisperse grain size distribution.

As the polymer latex for use in the present invention, not only an ordinary uniform-structured polymer latex but also a so-called core/shell type latex are available. In some cases, it is preferred that the core and the shell have different glass transition points.

Preferable range of the glass transition point ($T_g$) of the polymer latex used as the binder in the present invention differ according to its use for the protective layer, back layer or image producing layer. For use in the image producing layer, the glass transition point is preferably from −30 to 40.

C., so that the photographically useful material can accelerratingly disperse at the time of heat development. For use in the protective layer and back layer, a glass transition point of 25 to 70. C. is preferable since the layers come into contact with various kinds of equipment.

The polymer latex for use in the present invention preferably has a minimum film-forming temperature (MFT) of from −30 to 90. C., more preferably from 0 to 70. C. In order to control the MFT, a film-forming aid may be added. The film-forming aid, also called a plasticizer, refers to an organic compound (usually an organic solvent) capable of lowering the MFT of the polymer latex, which is described, for example, in "Gosei Latex no Kagaku (Chemistry of Synthetic Latex)", by Souichi Muroi, issued by Kobunshi Kanko Kai (1970), supra.

The polymer species of the polymer latex for use in the present invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image producing layer, whereas too large in degraded and undesirable film-forming property.

Specific examples of the polymer latex for use in the present invention include methyl methacrylate/ethyl acrylate/methacrylic acid copolymer latex, methyl methacrylate/butadiene/itaconic acid copolymer latex, ethyl acrylate/metacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. More specifically, examples of which include copolymer latex expressed by methyl methacrylate/ethyl acrylate/methacrylic acid=33.5/50/16.5 (wt %), copolymer latex expressed by methyl methacrylate/butadiene/itaconic acid=47.5/47.5/5 (wt %), and copolymer latex expressed by ethyl acrylate/methacrylic acid=95/5 (wt %). Such polymers are also commercially available, which include acrylic resins such as CEBIAN A-4635, 46583 and 4601 (all produced by Dicel Chemical Industries, Ltd.), Nipol Lx811, 814, 821, 820, 857 (all produced by Nippon Zeon K K) and VONCORT-R3340, R3360, R3370 and 4280 (Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx410, 430, 435 and 438C (all produced by Nippon Zeon KK); vinyl chloride resins such as G351, G576 (both produced by Nippon Zeon K K); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more species.

In the image producing layer, the polymer latex preferably accounts for 50 wt % or more of the total binder, and more preferably 70 wt % or more. That is, 50 wt % or more, and preferably 70 wt % or more of the total binder in the image producing layer is desirably composed of the foregoing polymer latex having a glass transition point. from −30 to 40. C.

To the image producing layer, it is allowable to add, as required, hydrophilic polymer such as gelatin, polyvinyl alcohol, methylcellulose, hydroxypropylcellulose, carboxymethylcellulose, and hydroxypropylmethylcellulose. An amount of addition of these hydrophilic polymers is preferably 30 wt % or less of the total binder of the image producing layer, and more preferably 15 wt % or less.

It is preferable in the present invention that the image producing layer is formed by coating a water-base liquid, which is followed by drying. Here, "water-base" described herein refers to that water accounts for 60 wt % or more of the solvent (dispersion medium) of the coating liquid. Possible component of the coating liquid other than water may be water-miscible organic solvent such as methanol, ethanol, isopropanol, Methyl cellosolve, Ethyl Cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

An amount of the total binder of the image producing layer is preferably 0.2 to 30 $g/m^2$ and more preferably 1 to 15 $g/m^2$. The image producing layer may be added with a cross-linking agent for crosslinking or a surfactant for improving coating property.

A combination of polymer latexes with different I/O values is preferably used as a binder for the protective layer, where the I/O value is defined as an inorganicity value divided by an organicity value, both values being found in a conceptional organicity chart described in the paragraphs [0025] to [0029] of Japanese Patent Application No. 11-6872.

In the present invention, it is allowable to add, as required, plasticizers (e.g., benzyl alcohol and 2,2,4-trimethylpentanediol-1,3-monoisobutylate) described in the paragraphs [0021] to [0025] of Japanese Patent Application No. 11-143058 to control the film forming temperature. It is also allowable to add a hydrophilic polymer into a polymer binder and add a water-miscible organic solvent into a coating liquid as disclosed in the paragraphs [0027] to [0028] of Japanese Patent Application No. 11-6872.

It is also allowable to form the individual layers using a first polymer latex having a functional group introduced therein as described in the paragraphs [0023] to [0041] of JP-A-2000-19678, together with a crosslinking agent and/or a second polymer latex having a functional group capable of reacting with the first polymer latex.

Examples of such functional group include carboxyl group, hydroxyl group, isocyanate group, epoxy group, N-methylol group and oxazolinyl group; and examples of such crosslinking agent include epoxy compounds, isocyanate compounds, block isocyanate compounds, methylol compounds, hydroxyl compounds, carboxyl compounds, amino compounds, ethyleneimine compounds, aldehyde compounds and halogen compounds. More specifically, examples of the crosslinking agent include isocyanate compounds such as hexamethylene isocyanate, Duranate WB40 to 80D, WX-1741 (products of Asahi Chemical), Bayhidur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), and water-dispersed polyisocyanate disclosed in JP-A-9-160172; amino compound such as Sumitex Resin M-3 (Sumitomo Chemical); epoxy compound such as Denacol EX-614B (Nagase Chemicals, Ltd.); and halogen compound such as 2,4-dichloro-6-hydroxy-1,3,5-triazine sodium salt.

An amount of the total binder of the image producing layer is preferably 0.2 to 30 g/m$^2$, and more preferably 1.0 to 15 g/m$^2$.

An amount of total binder in the protective layer is preferably 0.2 to 10.0 g/m$^2$, and more preferably 0.5 to 6.0 g/m$^2$.

An amount of total binder in the back layer is preferably 0.01 to 10.0 g/m$^2$, and more preferably 0.05 to 5.0 g/m$^2$.

In some cases, the image producing layer, protective layer and back layer are individually provided in the numbers of two or more. For the case that two or more image producing layer are provided, it is preferable to use the polymer latex for the binder of all layers. The protective layer is provided, sometimes in two or more layers, on the image producing layer, in which it is preferable to use the polymer latex at least in one protective layer, and in particular in the outermost one. The back layer is provided, sometimes in two or more layers, on the undercoated layer on the back side of the substrate, in which it is preferable to use the polymer latex at least in one back layer, and in particular in the outermost one.

The slipping aid in the context of the present invention means a compound which can lower the friction coefficient of the surface of an object when provided thereon, as compared with the surface not provided with such compound.

Specific examples of the slipping aid are typified as those described in the paragraphs [0061] to [0064] of JP-A-11-84573, and the paragraphs [0049] to [0062] of JP-A-11-106881.

Preferable slipping aids are available as Cellosol 524 (major component: carnauba wax), Polyron A, 393, H-481 (major component: polyethylene wax), Himicron G-111 (major component: ethylene bisstearate amide), Himicron G-270 (major component: stearate amide) (all produced by Chukyo Yushi K.K.) and the compounds expressed by the formulae below:

W-1: $C_{16}H_{35}$—O—$SO_3Na$; and

W-2: $C_{18}H_{37}$—O—$SO_3Na$.

The amount of addition of the slipping aid is preferably 0.1 to 50 wt % of the binder in the target layer, and more preferably 0.5 to 30 wt %.

Reat development in the present invention can be effected using, for example, a heat developing apparatus as disclosed in JP-A-2000-171935 and Japanese Patent Application No. 11-106881, in which in the preheating zone the photosensitive material is conveyed with opposed rollers, and in the heat developing zone the photosensitive material is conveyed so that the top surface of the image producing layer side thereof is roller-driven, and the opposite side is slid on a smooth plane. In such development process, a ratio of friction coefficients of the outermost surface of the image producing layer and the outermost surface of the back layer, at the development temperature, is selected as 1.5 or above, and at most 30 or around, although the upper limit being not specifically limited. A friction coefficient of the back layer ($\mu_b$) is preferably 1.0 or below, and more preferably 0.05 to 0.8, which can be obtained from the equation below:

$$\text{ratio of friction coefficient} = \mu_e/\mu_b$$

where, $\mu_e$=dynamic friction coefficient between the roller members of the heat developing apparatus and the outermost surface of the image producing layer side; and $\mu_b$=dynamic friction coefficient between the smooth plane member of the heat developing apparatus and the surface of the back layer.

The slipping property between the contact members of the heat developing apparatus and the outermost layers of the image producing layer side and/or the rear side can be adjusted by adding the slipping aid to the outermost layer and altering the amount of addition thereof.

On both sides of the support, it is preferable to provide an undercoat layer containing a vinylidene chloride copolymer containing a repetitive unit of vinylidene chloride monomer at 70 wt % or above. Such copolymer is disclosed, for example, in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, from line 20 in the right column on page 2 to line 30 in the right column on page 3 of Japanese Patent No. 2,557,641, paragraphs from [0020] to [0037] of JP-A-2000-39684, and paragraphs from [0063] to [0080] of Japanese Patent Application No. 11-106881.

The amount of vinylidene chloride monomer of less than 70 wt % will result in insufficient moisture resistance, and will cause large dimensional changes with time after the heat development. The vinylidene chloride copolymer preferably contains, as a repetitive unit other than the vinylidene chloride monomer, a repetitive unit of a vinyl monomer containing a carboxyl group. This is because a polymer consisting only of vinyl chloride monomers may crystallize, which makes it difficult to form a uniform moisture-proof layer by coating, and also because the vinyl chloride monomer containing the carboxyl group is indispensable for stabilizing the polymer.

In the present invention, the molecular weight of the vinylidene chloride copolymer, as expressed in weight average molecular weight, is preferably 45,000 or below, and more preferably 10,000 to 45,000. Too large molecular weight may degrade the adhesiveness of the vinylidene chloride layer to the support made of polyester or the like.

Content of the vinylidene chloride, as expressed in the total thickness of the undercoat layers containing thereof on one side of the support, is 0.3 $\mu$m or above, and more preferably 0.3 to 4 $\mu$m.

The vinylidene chloride copolymer layer as an undercoat layer is preferably provided as a first layer formed directly on the support, and may be provided in two or more layers, while one layer each on both sides of the support being the general practice. When two or more layers are provided, total amount of the vinylidene chloride copolymer will be adjusted within the desired range of the present invention.

Such layer may contain, besides the vinylidene chloride copolymer, a crosslinking agent or a matting agent.

On the substrate, it is optionally allowable to form, by coating, an undercoat layer containing SBR (styrene butadiene rubber), polyester or gelatin as a binder, in addition to the vinylidene chloride copolymer layer. The undercoat layer can be formed in a multi-layered structure, and can be provided either on the single side or both sides of the support. Typical thickness of the undercoat layer is 0.01 to 5 $\mu$m, and more preferably 0.05 to 1 $\mu$m (per layer).

A variety of supports are available for the photothermographic material of the present invention. Typical materials for the support include polyesters such as polyethylene terephthalate and polyethylene naphthalate; cellulose nitrate; cellulose ester; polyvinyl acetal; syndiotactic polystyrene; polycarbonate; and paper having both sides thereof coated with polyethylene. Among these, a biaxially stretched polyester, in particular such polyethylene terephthalate (PET) is preferable in terms of its excellent dimensional stability and chemical resistance. The thickness of the support, excluding that of the undercoat layer, is preferably 90 to 180 $\mu$m.

As the support of the photothermographic material of the present invention, preferably used is a polyester film, and in particular polyethylene terephthalate film, annealed at 130 to 185° C. to relax residual internal stress caused by the biaxial stretching and thereby to prevent heat-shrinking distortion during the heat development; such film typically disclosed in JP-A-10-48772, JP-A-10-10676, JP-A-10-10677, JP-A-11-65025 and JP-A-11-138648.

Rate of dimensional change of the support after annealed at 120° C. for 30 seconds is preferably −0.03 to +0.01% in the moving direction (MD) and 0 to +0.04% in the transverse direction (TD).

The photothermographic material of the present invention may be subjected to antistatic treatment in order to reduce dust adhesion, to prevent static mark from generating, and to avoid conveyance failure in an automatic conveying process, where the antistatic treatment being effected with an electro-conductive metal oxide and/or fluorine-containing surfactant disclosed in the paragraphs from [0040] to [0051] of JP-A-11-84573. Preferable examples of the electro-conductive metal oxide include an antimony-doped acicular electro-conductive stannic oxide disclosed in U.S. Pat. No. 5,575,957and the paragraphs from [0012] to [0020] of JP-A-2000-223901; and an antimony-doped fibrous stannic oxide disclosed in JP-A-4-29134.

The surface specific resistivity (surface resistivity) of a layer containing such metal oxide is $10^{12}\Omega$ or below, and more preferably $10^{11}\Omega$ or below in an atmosphere of 25° C., 20% RH (relative humidity), which ensures an excellent antistatic property. A lower limit of the surface resistivity is $10^{7}\Omega$ or around in general, while being not limited specifically.

In the present invention, it is preferable that at least either one, and more preferably both, of the outermost layers on the image producing layer side and the opposite side of the photothermographic material has a Bekk smoothness of 2,000 seconds or below, and more preferably 10 to 2,000 seconds.

The Bekk smoothness in the present invention will readily be obtained according to Japanese Industrial Standard (JIS) P8119 "Paper and board—Determination of smoothness by Bekk method" and TAPPI standard method T479.

Bekk smoothness of the outermost layers on the image producing layer side and the opposite side thereof of the photothermographic material can be controlled by properly adjusting the grain size and an amount of addition of a matting agent included in such layers, as disclosed in the paragraphs from [0052] to [0059] of JP-A-11-84573.

In the present invention, it is preferable to use a water-soluble polymer as a thickening agent to improve the coating property, where both of natural and synthetic polymers are acceptable. Natural polymers include starches (e.g., corn starch, starch), seaweed (agar, sodium arginate), vegetative tacky substance (gum arabic), animal protein (glue, casein, gelatin, egg albumen) and fermented tacky substance (e.g., pullulan, dextrin); semisynthetic polymers include starchy material (e.g., solubilized starch, carboxyl starch, dextran) and cellulosic material (e.g., viscose, methyl cellulose, ethyl cellulose, carboxymethyl cellulose, hydroxyethyl cellulose, hydroxypropyl cellulose, hydroxypropylmethyl cellulose); and synthetic polymers (e.g., polyvinyl alcohol, polyacrylamide, polyvinyl pyrrolidone, polyethylene glycol, polypropylene glycol, polyvinyl ether, polyethylene imine, polystyrenesulfonic acid or copolymer thereof, polyvinyl sulfanic acid or copolymer thereof, polyacrylic acid or copolymer thereof, acrylic acid or copolymer thereof, maleic acid monoester copolymer, maleic acid monoester copolymer, and acryloylmethylpropanesulfonic acid or copolymer thereof).

Among such water-soluble polymers preferably available are sodium arginate, gelatin, dextran, dextrin, methyl cellulose, carboxymethyl cellulose, hydroxyethyl cellulose, hydroxypropyl cellulose, polyvinyl alcohol, polyacrylamide, polyvinyl pyrrolidone, polyethylene glycol, polypropylene glycol, polystyrenesulfonic acid or copolymer thereof, polyacrylic acid or copolymer thereof, maleic acid monoester copolymer and acryloylmethylpropanesulfonic acid or copolymer thereof, all of which being preferably used as a thickener.

Particularly preferable examples of which include gelatin, dextran, methyl cellulose, carboxymethyl cellulose, hydroxyethyl cellulose, polyvinyl alcohol, polyacrylamide, polyvinyl pyrrolidone, polystyrenesulfonic acid or copolymer thereof, polyacrylic acid or copolymer thereof and maleic acid monoester copolymer. These compounds are detailed in "Shin Suiyousei Porima no Oyo to Shijo (New Edition: Applications and Market of Water-Soluble Polymers), published by CMC, edited by Shinji Nagatomo, issued on Nov. 4, 1988).

An amount of addition of the water-soluble polymer as a thickener is not limitative so far as it can raise the viscosity of the coating liquid when added thereto. In general, the concentration in the liquid is in a range from 0.01 to 30 wt %, more preferably 0.05 to 20 wt %, and still more preferably 0.1 to 10 wt %. The viscosity achieved by addition of the polymer is preferably such that higher than the initial viscosity by 1 to 200 mPa·s, and more preferably 5 to 100 mPa·s. The measurement values described herein are those obtained from measurement using a B-type rotary viscometer at 25° C. For the case of addition of a thickener to the coating liquid or so, it is generally preferable to add the thickener in a form of solution diluted as possible. It is also preferable to keep vigorous stirring during the addition.

Next, surfactants available for the present invention will be described. For the present invention, the surfactants can be classified by purpose of use such as dispersion aid, coating aid, wetting agent, antistatic agent and control agent for photographic property, and such purposes will be attained by properly using the surfactants listed below. The surfactants available in the present invention are of nonionic and ionic (anionic, cationic or betaine-type). Also fluorine-containing surfactant is preferably used.

Preferable nonionic surfactants include those having polyoxyethylene, polyoxypropylene, polyoxybutylene, polyglycidyl or sorbitan as a nonionic hydrophilic group, which are specified as polyoxyethylenealkyl ether, polyoxyethylenealkyl phenyl ether, polyoxyethylene-polyoxypropylene glycol, polyvalent alcohol. fatty acid partial ester, polyoxyethylene polyvalent alcohol fatty acid partial ester, polyoxyethylene fatty acid ester, polyglyceline fatty acid ester, fatty acid diethanolamide and triethanolamine fatty acid partial ester.

Anionic surfactants include carboxylate, sulfate, sulfonate and phosphoric ester salt; and more specifically, fatty acid salt, alkylbenzenesulfonate, alkylnaphthalenesulfonate, alkylsulfonate, α-olefinsulfonate, dialkylsulfosuccinate, α-sulfonated fatty acid salt, N-methyl-N-oleyltaurine, petroleum sulfonate, alkylsulfate, sulfated oils and fats, polyoxyethylene alkyl ether sulfate, polyoxyethylene alkyl phenyl ether sulfate, polyoxyethylene styrenized phenyl ether sulfate, alkylphosphate, polyoxyethylene alkylether phosphate and naphthalenesulfonate-formaldehyde condensate.

Cationic surfactants include amine salt, quaternary ammonium salt and pyridinium salt; and more specifically, primary to tertiary aliphatic amine salts and quaternary amonium salt (tetraalkyl ammonium salt, trialkylbenzyl ammonium salt, alkylpyridinium salt, alkylimidazolium salt).

Betaine-type surfactants include calboxybetaine and sulfobetaine, and more specifically, N-trialkyl-N-carboxymethylammonium betaine and N-trialkyl-N-sulfoalkyleneammonium betaine.

These surfactants are described in "Kaimen Kasseizai no Oyo (Applications of Surfactants)", written by Takao Karume, published by Saiwai Shobo, Sep. 1, 1980. An amount of use of the preferable surfactants is not limitative so far as they can exert a desired surface activation property. An amount of use of a fluorine-containing surfactant is preferably 0.01 to 250 mg/m$^2$.

Specific examples of the surfactants are listed below, while the surfactants available are by no means limited thereto (where —$C_6H_4$— represents a phenylene group).

WA-1: $C_{16}H_{33}(OCH_2CH_2)_{10}OH$

WA-2: $C_9H_{19}$—$C_6H_4$—$(OCH_2CH_2)_{12}OH$

WA-3: sodium dodecylbenzenesulfonate

WA-4: sodium tri(isopropyl)naphthalenesulfonate

WA-5: sodium tri(isobutyl)naphthalenesulfonate

WA-6: sodium dodecylsulfate

WA-7: α-sulfasuccinic acid di(2ethylhexyl)ester sodium salt

WA-8: $C_8H_{17}$—$C_6H_4$—$(CH_2CH_2O)_3(CH_2)_2SO_3K$

WA-10: cetyl trimethylamonium chloride

WA-11: $C_{11}H_{23}CONHCH_2CH_2N^{(+)}(CH_3)_2$—$CH_2COO^{(-)}$

WA-12: $C_8H_{17}SO_2N(C_3H_7)(CH_2CH_2O)_{16}H$

WA-13: $C_8H_{17}SO_2N(C_3H_7)CH_2COOK$

WA-14: $C_8H_{17}SO_3K$

WA-15: $C_8H_{17}SO_2N(C_3H_7)(CH_2CH_2O)_4(CH_2)_4SO_3Na$

WA-16: $C_8H_{17}SO_2N(C_3H_7)(CH_2)_3OCH_2CH_2N^{(+)}(CH_3)_3$—$CH_2$—$C_6H_4$—$SO_3^{(-)}$

WA-17: $C_8H_{17}SO_2N(C_3H_7)CH_2CH_2CH_2N^{(+)}(CH_3)_2$—$CH_2COO^{(-)}$

In a preferred embodiment of the present invention, an intermediate layer can optionally be provided in addition to the image recording layer and the protective layer, where these pluralities of layers can be formed by the simultaneous multi-layer coating using water-base coating liquids for the purpose of improving the productivity. Methods for the coating include extrusion coating, slide bead coating and curtain coating; and a particularly preferable one relates to the slide bead coating disclosed in FIG. 1 of JP-A-2000-2964.

In the case of using a silver halide photosensitive material containing gelatin as a major binder, the photosensitive material will rapidly be cooled in a first drying zone provided on the downstream of a coating die, where a coated film is immobilized due to gellation of the gelatin. Thus immobilized and non-fluidized coated film is then sent to a second drying zone, where, and in any successive drying zone, the solvent contained in the coated film will be vaporized to afford a solid film. Drying system for the second drying zone and thereafter includes an air-loop system in which air jet is blown from an U-duct to the support carried on the rollers, and a spiral system (air floating system) in which the support is dried during conveyance while being spirally wound on a cylindrical duct.

As for the coating liquid containing polymer latex as a major component of the binder, preheating only in the first drying zone may sometimes be insufficient since the rapid cooling cannot immobilize the coated film. In such a case, the drying system suitable for a silver halide photographic photosensitive material will likely to cause non-uniform liquid flow or drying, which may result in serious degradation in the coated surface quality.

A preferable drying system for the present invention is not limited to such that having the first and second drying zones as disclosed in JP-A-2000-2964, but may be such that using a horizontal drying zone at least the constant-rate drying is completed. Conveyance of the support immediately after the coating through the introduction into the horizontal drying zone is not necessarily performed in a horizontal manner, and a rising angle from the horizontal level of the coating apparatus may reside in 0 to 70°. It is to be understood that the horizontal drying zone described in this specification never requires the conveyance of the support in an absolutely horizontal manner, but permits deflection within ±15° from the horizontal level of the coating apparatus.

The constant-rate drying in the context of this specification means a drying process such that the whole amount of incoming heat while keeping the liquid film temperature constant will be consumed for vaporizing the solvent. The falling-rate drying means a drying process such that the drying rate falls in the terminal period due to miscellaneous factors (rate-determined by internal water migration or diffusion within the material, or recession of the vaporization surface), and incoming heat also contributes the temperature rise of the liquid film. A critical moisture content allowing transition from the constant-drying-rate process to falling-drying-rate process resides in a range from 200 to 300%. While a drying process known for the silver halide photographic photosensitive material may also be applicable since the coated film will thoroughly be dried to be immobilized upon completion of the constant-rate drying, it is more preferable in the present invention to sustain the drying in the horizontal drying zone until the final dry point is reached even after the constant-rate drying period.

In the formation of the image producing layer and/or protective layer, a surface temperature of the liquid film during the constant-rate drying is preferably higher than the minimum film-formation temperature (MFT) of the polymer latex (generally higher than the glass transition point $T_g$ of the polymer by 3 to 5°), and is usually set within a range from 25 to 40° C. limited by performances of the production facility. The dry bulb temperature during the falling-rate drying is preferably set to a temperature lower than the glass transition point $T_g$ of the support (usually 80° C. or below for PET support). The liquid film surface temperature in the context of the present invention refers to a surface temperature of the coated liquid film, and more specifically solvent film, coated on the support, and the dry bulb temperature refers to a temperature of drying air flow in the drying zone.

If the constant-rate drying is proceeded based on conditions allowing temperature fall of the liquid film surface, the drying tends to be incomplete, which will significantly degrade the film forming property in particular of the protective layer and will readily produce cracks on the film surface. This may also weaken the film strength so that a critical problem such that getting scratches during the conveyance within an exposure apparatus or heat developing apparatus may occur.

On the contrary, if the drying is effected so as to raise the liquid film surface temperature, surface irregularity tends to occur since the protective layer mainly composed of the polymer latex can rapidly form a film, whereas the lower layers including the image producing layer can still fluidize. Applying an excessive heat on the support (base) exceeding the glass transition point $T_g$ thereof also tends to ruin the dimensional stability or curling resistance of the photosensitive material.

In particular in the simultaneous multi-layer coating, in which the upper layer is stacked on the lower layer still in the wet state and both layer are concomitantly dried, and while the same will apply to the sequential coating in which the upper layer is formed on the lower layer being already coated and dried, it is preferable to adjust a pH difference between the coating liquids for the image producing layer and the protective layer to 2.5 or below, where a smaller pH difference the better. Increase in the pH difference tends to promote a microscopic agglomeration at the interface of the coated liquids, which will result in a critical failure in the surface property such as coating streaks during long span continuous coating.

Viscosity at 25° C. of the coating liquid for the image producing layer is preferably 15 to 100 mPa·s, and more preferably 30 to 70 mPa·s. Viscosity at 25° C. of the coating liquid for the protective layer is preferably 5 to 75 mPa·s and more preferably 20 to 50 mPa·s. The viscosities can be measured using a B-type viscometer.

Winding up after the drying is preferably conducted at 20 to 30° C., and a relative humidity of 45±20%. The winding orientation can be optional for the convenience of successive processes, that is, the image producing side may be orientated outward or inward. For the case that the material is processed in a rolled state, such rolled state may preferably be inside-out in order to eliminate the curl generated in the winding. Humidity of the photosensitive material is preferably controlled within a range from 20 to 55% (measured at 25° C.).

In the conventional photographic emulsion coating liquid, which is a viscous liquid containing silver halide grains and gelatin matrix, air bubbles will easily dissolve into the liquid and disappear simply by feeding the liquid under pressure, and the air bubbles will scarcely emerge again even the atmospheric pressure is recovered during the coating.

On the contrary, the coating liquid for the image producing layer containing the organic acid silver salt, polymer latex and the like for use in the present invention tends to result in insufficient defoaming simply by the pressure liquid feeding. Thus it is preferable to feed the liquid under ultrasonic vibration for deforming so as not to generate the gas-liquid interface.

Defoaming of the coated liquid in the present invention is preferably performed by preliminarily degassing the precoating liquid under a reduced pressure, and feeding the coating liquid while maintaining the liquid under a pressure of 1.5 kg/cm$^2$ or above, under a continuous flow so as to prevent gas-liquid interface from generating, and under application of ultrasonic vibration. A specific example of such method is described in JP-B-55-6405 (line 20 on page 4 to line 11 on page 7). An apparatus for implementing such defoaming is exemplified as that disclosed in Example and FIG. 3 of JP-A-2000-98534.

Pressure preferably exerted on the coating liquid is preferably 1.5 kg/cm$^2$ or above, more preferably 1.8 kg/cm$^2$ or above, and an upper limit is around 5 kg/cm$^2$ in general, while being not limited thereto. Sound pressure of the applied ultrasonic wave is 0.2 V or above, and more preferably 0.5 to 3.0V. Higher sound pressure is more preferable in general, where too high sound pressure will cause cavitation and thus locally raise the temperature, which may result in fog. While the sound frequency is not limitative, it is generally selected at 10 kHz or above, and more preferably 20 to 200 kHz. Now, the reduced-pressure defoaming herein relates to closing the tank (liquid reserving tank or storage tank in general), reducing the pressure in the tank to expand the air bubbles entrained in the coating liquid, and making the bubbles escape from the liquid facilitated by their increased buoyancy. The pressure during the reduced-pressure defoaming is −200 mmHg or lower (a pressure lower than the atmospheric pressure by 200 mg or more), and more preferably −250 mmHg or lower, and a lowest pressure of −800 mmHg or around in general, while being not limited thereto. Period of pressure reduction is 30 minutes or longer, and more preferably 45 minutes or longer, where an upper limit is not specifically defined.

In the present invention, the image producing layer, the protective layer for the image producing layer, undercoat or back layer may contain a dye for an antihalation purpose as discussed in the paragraphs from [0204] to [0208] of JP-A-11-84573, and the paragraphs from [0240] to [0241] of Japanese Patent Application No. 11-106881.

The image producing layer may contain a dye or pigment of various types so as to improve the color tone or prevent the irradiation. Any dye or pigment may be used in the photosensitive layer, and examples thereof include compounds described in the paragraph [0297] of JP-A-11-119374. The compounds may be added in any form of solution, emulsified product or solid microgram dispersion or may be added in the state mordanted with a polymer mordant. An amount of such compounds used may be determined according to desired absorbance, and, in general, the compounds are preferably used in an amount of from $1\cdot10^{-6}$ to 1 g per m$^2$ of the photothermographic material.

When an antihalation dye is used in the present invention, such dye may be any compound provided that it has a desired absorption within a predetermined wavelength region, that it is sufficiently low in absorption in the visible wavelength region after the processing, and that it can allow the back layer to exhibit a desired absorbance spectrum pattern. Compounds disclosed in the paragraph [0300] of JP-A-11-119374 are available. Other available methods include such that reducing density produced by dye using heat-assisted fading as described in Belgian Patent No. 733,706, and such that decreasing the density by photo-irradiation-assisted fading described in JP-A-54-17833.

For the case that the photothermographic material is used as a mask in a process of printing plate making with a presensitized plate, such photothermographic material after the heat development will have image information for setting exposure conditions for exposing the presensitized plate by a photoengraving machine, mask pattern, and plate making conditions such as conveyance conditions of the presensitized plate. Thus the density (amount of use) of the foregoing irradiation preventive dye, antihalation dye or filter dye is limited so as not to interfere the detection of such information. That is, $D_{min}$ (minimum density) in the wavelength range recognizable by a sensor must be low, which is expressed by an absorbance of 0.3 or below, since the information is detected with an LED or laser device. For example, a photoengraving machine model S-FNRIII (manufactured by Fuji Photo Film Co., Ltd.) has a detector for detecting register and a 670-nm light source in a bar code reader. Also a photoengraving machine model APML Series (manufactured by Shimizu Seisakusha K.K.) has a 670-nm light source in a bar code reader. So that too high $D_{min}$ (minimum density) around 670 nm will prevent the information on the film from being correctly read out, which will result in process error in the photoengraving machine due to conveyance failure and inappropriate exposure. Thus information reading using a 670-nm light source requires low $D_{min}$ around 670 nm, and an absorbance in a wavelength region from 660 to 680 nm after the heat development of 0.3 or below, more preferably 0.25 or below. While the lower limit is not limitative, it will generally be 0.10 or around.

In the present invention, an exposure apparatus used for the image-wise exposure may be of any type provided that it affords an exposure period of $10^{-15}$ to $10^{-7}$ seconds, and is preferably in general such apparatus having a light source such as a laser diode (LD) or light emitting diode (LED). LD is more preferable in terms of high output and excellent resolution. These light sources may be of any type provided that they can emit light within an electromagnetic spectral range of desired wavelengths. Available LDs include, for example, a dye laser, gas laser, solid state laser and semiconductor laser. Exposure time is preferably set within a range from $10^{15}$ to $10^{-7}$ seconds, and more preferably from $10^{-11}$ to $10^{-7}$ seconds.

Irradiation energy is preferably 5 $\mu J/cm^2$ to 1 $mJ/cm^2$, and more preferably 10 $\mu J/cm^2$ to 200 $\mu J/cm^2$.

In the present invention, the exposure is effected so that the beam loca are partially overlapped. The overlap means that the subscanning pitch width is smaller than the beam spot diameter. When the beam spot diameter is expressed by, for example, a half width of the beam intensity (FWHM), the overlap can quantitatively be expressed by FWHM/subscanning pitch width (overlap coefficient). The overlap coefficient is preferably 0.2 or larger in the present invention.

There is no special limitation on the scanning system of the light source of the exposure apparatus employed in the present invention, and available systems include outer cylinder surface scanning system, inner cylinder surface scanning system and planar scanning system. Both of single channel and multi-channel systems are available for the light source, where the multi-channel system is preferable for the outer cylinder surface scanning system. That is, multi-beam exposure using two or more laser heads is preferable.

The photothermographic material generally has a low haze at the time of exposure and is liable to incur generation of interference fringes. Known techniques for preventing the generation of interference fringes include such that entering a laser light obliquely with respect to the recording material disclosed in JP-A-5-113548, and such that using a multimode laser disclosed in International Patent Publication WO95/31754, both of which are preferably used.

The photothermographic material of the present invention may be developed by any method, while in general the development is performed by elevating the temperature of the recording material after the image-wise exposure. Preferred embodiments of the heat-developing apparatus used include: those making the photothermographic material into contact with a heat source such as a heat roller or heat drum as disclosed in JP-B-5-56499, JP-A-9-292695, JP-A-9-297385 and International Patent Publication WO95/30934; and those of non-contacting type as disclosed in JP-A-7-13294, International Patent Publications WO97/28489, WO97/28488 and WO97/28487. Of these, the non-contacting type heat-developing apparatus is preferred. The development temperature is preferably from 80 to 250. C., more preferably from 100 to 140. C. The development time is preferably from 1 to 180 seconds, more preferably from 5 to 90 seconds.

For preventing uneven processing due to dimensional changes in the photothermographic material during heat development, it is preferable to heat the material at a temperature of 80. C. or above and less than 115. C. for 5 seconds or more so as to prevent the image from appearing, and then develop the material by heating at a temperature of 110 to 140° C. to produce the image (so-called multi-stage heating method).

In the heat development of the photothermographic material, a part of the components contained in such material or a part of decomposition products thereof ascribable to the heat development may vaporize due to heat exposure at 110° C. or above. Such vaporized components are known to exert various adverse effects such as causing non-uniform development, corroding composition members of the heat developing apparatus, deforming image through depositing at a low temperature site to produce foreign matters, and adhering on and thus fouling the image. Known methods for eliminating such adverse effects relate to providing the heat developing apparatus with a filter, and to optimizing the air flow within the apparatus. These measures may effectively be combined.

A heating apparatus for effecting contact heating of the film and provided with a filter cartridge is disclosed in International Patent Publications WO95/30933, WO97/21150 and JP-W-A-10-500496 (the code "JP-W-A" as used herein means an "international application published in Japanese for Japanese national phase"), where the filter cartridge has a first opening packed with bond-absorption grains for introducing volatiles and a second opening for exhaust. Use of a filter comprising a heat-conductive condensing collector and a gas-absorption grain filter as combined therewith is disclosed in WO96/12213 and JP-W-A-10-507403. These measures may properly be employed in the present invention.

In U.S. Pat. No. 4,518,845 and JP-B-3-54331, disclosed is a constitution involving an apparatus for exhausting volatile components emitted from the film, a pressure apparatus for pressing the film to a heat-conductive member, and a heating apparatus for heating the heat-conductive member. WO98/27458 discloses a method for removing volatile components emitted from the film, which may be causative of increased fog, from the surface of such film. These measures may also properly be employed in the present invention.

An exemplary constitution of a heat developing apparatus used for the heat development of the photothermographic material of the present invention is shown in FIG. 1. FIG. 1 shows a side view of the heat developing apparatus. The apparatus has a feed-in roller pair 11 (the upper roller being a silicone rubber roller and the lower one being an aluminum-made heat roller) for introducing the photothermographic material 10 into a heating section while straightening and preheating it, and has an eject roller pair 12 for ejecting the photothermographic material 10 from the heating section after the heat development in a straightened manner. The photothermographic material 10 is heat-developed during a period of its travel from the feed-in roller pair 11 to the eject roller pair 12. In a conveying means for conveying the photothermographic material 10, a plurality of rollers 13 are aligned on the side where the contact with the top surface of the image producing layer side may occur, and a smooth plane 14 is provided on the opposite side where the contact with the back surface may occur, the surface of the smooth plane 14 being laminated with a non-woven fabric (made of, for example, aromatic polyamide or polytetrafluoroethylene). The photothermographic material 10 is conveyed with the aid of the plurality of rollers 13 driven under contact with the image producing layer side, while the back surface being slid on the smooth plane 14. As a heating means, heaters 15 are aligned behind the rollers 13 and the smooth plane 14 so as to heat the photothermographic material 10 from both sides. Such heating means can be typified as a plate heater or the like. The clearance between the rollers 13 and the smooth plane 14 may vary depending on the materials composing the smooth plane 14, and can properly be adjusted, preferably to 0 to 1 mm, so as to allow a smooth conveyance of the photothermographic material 10.

Although materials and members composing the rollers 13 and smooth plane 14 may be of any type provided that they are durable to high temperatures and do not adversely affect the conveyance of the photothermographic material 10, silicone rubber is preferable for the surface of the rollers 13, and aromatic polyamide or Teflon (product name of polytetrafluoroethylene) for the smooth plane 14. It is also preferable to compose the heating means with a plurality of unit heaters and to arbitrarily select the individual temperatures.

The heating section is composed of a preheating section "A" having the feed-in roller pair 11 and a heat developing heating section "B" having the heater 15, where the preheating section "A" placed on the upper stream of the heat developing section "B" is preferably conditioned at a temperature lower than the heat development temperature (for example, lower by 10 to 30° C. or around), and at a temperature and process time sufficient for vaporize the moisture contained in the photothermographic material 10, and more specifically at a temperature higher than the glass transition point ($T_g$) of the support of the photothermographic material 10 so as to avoid non-uniformity in the development. Temperature difference between the preheating section "A" and the heat developing section "B" is preferably within ±1° C., and more preferably within ±0.5° C.

On the downstream side of the heat developing section "B", provided is a slow cooling section "C" having an eject roller pair 12 and a guide plate 16.

The guide plate 16 is preferably made of a material with a low heat conductivity, and the cooling is preferably performed gradually so as to avoid deformation of the photothermographic material 10, and more specifically at a cooling rate of 0.5 to 10° C./sec.

While the apparatus has been described referring to the illustrated example, a variety of other configurations, including such that disclosed in JP-A-7-13294, are allowable without limitation for use in the present invention. For the case of applying the multi-stage heating method, two or more heat sources differed in temperature settings can be provided so as to allow successive heating at different temperatures.

EXAMPLES

The present invention will be explained in more detail with reference to the following examples. Now, the materials, reagents, ratio, operation and so forth described hereinafter may properly be modified without departing from the spirit of the present invention. It is to be understood that the scope of the present invention, therefore, is by no means limited to specific embodiments described below.

Example 1

<<Preparation of Silver Halide Emulsion "A">>

To 700 ml of water, 11 g of alkali-treated gelatin (calcium content ≦2,700 ppm), 30 mg of potassium bromide and 1.3 g of sodium 4-methylbenzenesulfonate were dissolved at 40° C., pH of the mixture was adjusted at 6.5, and added thereto were 159 ml of an aqueous solution containing 18.6 g of silver nitrate and an aqueous solution containing 1 mol/L of potassium bromide, $5\times10^{-6}$ mol/L of $(NH_4)_2RhCl_5(H_2O)$, and $2\times10^{-5}$ mol/L of $K_3IrCl_6$ over 6 minutes and 30 seconds by the controlled double jet method while keeping pAg at 7.7. Further added thereto were 476 ml of an aqueous solution containing 55.5 mg of silver nitrate and an aqueous halogen salt solution containing 1 mol/L of potassium bromide and $2\times10^{-5}$ mol/L of $K_3IrCl_6$ over 28 minutes and 30 seconds by the controlled double jet method while keeping pAg at 7.7. The pH of the mixture was lowered to effect agglomerative precipitation and desalting, 51.1 g of low-molecular-weight gelatin (average molecular weight=15,000, calcium content ≦20 ppm) was added, and the pH and pAg were adjusted to 5.9 and 8.0, respectively. The obtained grains were found to be cubic grains having an average grain size of 0.08 μm, a coefficient of variation of the projected area of 9%, and a ratio of [100] plane of 90%.

The obtained silver halide grains were then heated to 60° C., added with $7.6\times10^{-5}$ mol/mol Ag of sodium benzenethiosulfonate, and 3 minutes after further added with $7.1\times10^{-5}$ mol/mol Ag of triethylthiourea, ripened for 100 minutes, added with $5\times10^{-4}$ mol/mol Ag of 4-hydroxy-6-methyl-1,3,3a,7-tetrazaindene and 0.17 g of Compound "A" shown below, and then cooled to 40° C.

While keeping the liquid temperature at 40° C. under stirring, $4.7\times10^{-2}$ mol/mol Ag of potassium bromide (as an aqueous solution), $12.8\times10^{-4}$ mol/mol Ag of Sensitization Dye "A" listed below (as an ethanol solution), and $6.4\times10^{-3}$ mol/mol Ag of Compound "B" listed below (as a methanol solution) were added, and 20 minutes after the mixture was rapidly cooled to 30° C., to thereby complete the preparation of silver halide emulsion "A".

Sensitization Dye "A"

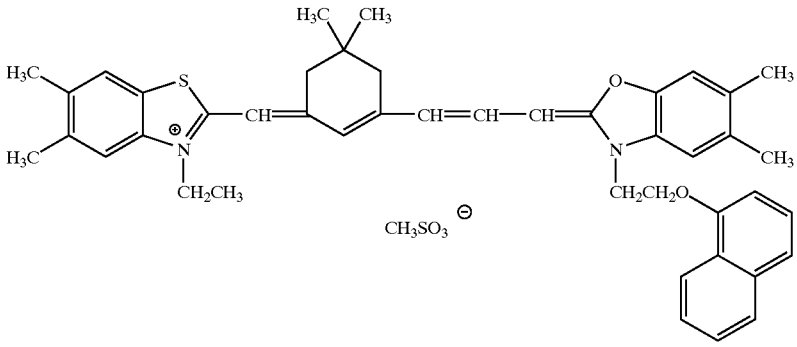

Compound "A"

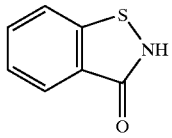

Compound "B"

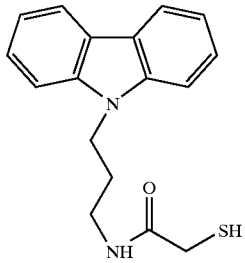

<<Preparation of Silver Behenate Dispersion "A">>

Sodium behenate solution was prepared by mixing 87.6 kg of behenic acid (Edenor C22-85R, product of Henkel Corporation), 423 L of distilled water, 49.2 L of a 5 mol/L aqueous NaOH solution and 120 L of tert-butanol, and allowing the mixture to react at 75° C. for one hour under stirring. Independently, 206.2 L of aqueous solution containing 40.4 kg of silver nitrate was prepared and kept at 10° C. A reaction vessel containing 635 L of distilled water and 30 L of tert-butanol was kept at 30° C., and an entire volume of the sodium behenate solution and an entire volume of the silver nitrate aqueous solution were added at constant flow rates over 62 minutes and 10 second, and over 60 minutes, respectively. In this process, only the silver nitrate aqueous solution was added in a first 7-minute-and-20-second period after the start of the addition, then sodium behenate solution was concomitantly added, and only sodium behenate solution was added in a last 9-minute-and-30-second period after the end of addition of the aqueous silver nitrate solution. The temperature of the content in the reaction vessel was kept at 30° C., and was controlled externally so as to avoid the liquid temperature rise. A piping in a feeding system of the sodium behenate solution was heated using a steam trace, in which a steam volume was adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and silver nitrate aqueous solution were symmetrically arranged centered round a stirring axis, and the heights of which were adjusted so as to avoid contact with the reaction solution.

After completion of the addition of the sodium behenate solution, the mixture was allowed to stand for 20 minutes under stirring with the temperature thereof unchanged, and then cooled to 25° C. The solid content was separated by centrifugal filtration, and then washed with water until electric conductivity of the wash water decreased as low as 30 μS/cm. The obtained solid content was stored in a form of a wet cake without drying.

From electron microscopic photographing, the obtained silver behenate grain was found to be a scaly crystal having an average sphere-equivalent diameter of 0.52 μm, an average grain thickness of 0.14 μm, and a sphere-equivalent coefficient of variation of 15%.

Next, the silver behenate dispersion was prepared by the procedures described below. To the wet cake equivalent to a dry weight of 100 g, 7.4 g of polyvinyl alcohol (product name; PVA-217, average degree of polymerization of ca. 1,700) and water were added to adjust a total weight of 385 g, and the mixture was then preliminarily dispersed using a homomixer. The preliminarily dispersed solution was then thoroughly dispersed three times using a dispersion apparatus (Micro Fluidizer M-110S-EH, manufactured by Micro Fluidex International Corporation, equipped with G10Z interaction chamber) under an operating pressure of 1,750 kg/cm$^2$, to obtain a silver behenate dispersion "A". During the dispersion, cooling operation was effected using coiled heat exchangers attached to the inlet side and outlet side of the interaction chamber, and the temperature of the coolant was controlled to keep the desired dispersion temperature.

The silver behenate grains contained in thus obtained silver behenate dispersion were found to have a volume weighted mean diameter of 0.52 μm and a coefficient of variation of 15%. The grain size was measured using MasterSizer X manufactured by Malvern Instruments, Ltd. observation through an electron microscope revealed a ratio of the long edge and short edge of 1.5, a grain thickness of 0.14 μm, and an average aspect ratio (ratio of circle-equivalent diameter of a projected grain area and grain thickness) of 5.1.

Preparation of Solid Microgram Dispersion of Reducing Agent "A"

Ten kilograms of Reducing Agent "A" [1,1-bis(2-hydroxy-3,5-dimethylphenyl)-3,5,5-trimethylhexane] and 10 kg of a 20 wt % aqueous solution of a modified polyvinyl alcohol (Poval MP-203, product of Kuraray Co., Ltd.) were added with 400 g of Surfinol 104E (product of Nissin Chemical Industry Co., Ltd.), 640 g of methanol and 16 kg of water, and then mixed thoroughly mixed to prepare a slurry. The slurry was then transferred using a diaphragm pump to a lateral sand mill (UVM-2, product of Aimex, Ltd.) packed with zirconia bead with an average diameter of 0.5 mm, dispersed for 3.5 hours, added with 4 g of benzoisothiazolinone sodium salt and water so as to adjust the concentration of the reducing agent to 25 wt %, to thereby obtain a solid microgram dispersion of the reducing agent. The reducing agent grains contained in thus obtained dispersion were found to have a median diameter of 0.44 μm, a maximum diameter of 2.0 μm or less, and a coefficient of variation of the average grain size of 19%. The obtained dispersion was filtered through a polypropylene filter with a pore size of 3.0 μm to separate dust or other foreign matters and then stored.

<<Preparation of Solid Microgram Dispersion of Organic Polyhalogen Compound "A">>

Ten kilograms of Organic Polyhalogen Compound "A", or tribromomethyl[4-(2,4,6-trimethylphenyl-sulfonyl) phenyl]sulfone, 10 kg of a 20 wt % aqueous solution of a modified polyvinylalcohol (Poval MP-203, product of Kuraray Co., Ltd.), and 639 g of a 20 wt % aqueous solution of sodium triisopropylnaphthalenesulfonate, 400 g of Surfinol 104E (product of Nissin Chemical Industry Co., Ltd.), and 640 g of methanol were added with 16 kg of water, and then mixed thoroughly to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 5 hours, and then added with water so as to adjust the concentration of Organic Polyhalogen Compound "A" to 25 wt %, to thereby obtain a solid microgram dispersion of Organic Polyhalogen Compound "A". The Organic Polyhalogen Compound grains contained in thus obtained dispersion were found to have a median diameter of 0.36 μm, a maximum diameter of 2.0 μm or less, and a coefficient of variation of the average grain size of 18%. The obtained dispersion was filtered through a polypropylene filter with a pore size of 3.0 μm to separate dust or other foreign matters and then stored.

Preparation of Solid Micrograin Dispersion of Organic Polyhalogen Compound "B"

Five kilograms of Organic Polyhalogen Compound "B", or tribromomethylnaphthylsulfone, 2.5 kg of a 20 wt % aqueous solution of a modified polyvinyl alcohol (Poval MP-203, product of Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 5 hours, added with 2.5 g of benzoisothiazolinone sodium salt and water so as to adjust the concentration of Organic Polyhalogen Compound "B" to 20 wt %, to obtain a solid microgram dispersion of organic Polyhalogen Compound "B". Organic polyhalogen compound grains contained in thus obtained dispersion were found to have a median diameter of 0.38 μm, a maximum diameter of 2.0 μm or less, and a coefficient of variation of the average grain size of 20%. The obtained dispersion was filtered through a polypropylene filter with a pore size of 3.0 μm to separate dust or other foreign matters and then stored.

Preparation of Aqueous Solution of Organic Polyhalogen Compound "C"

| Formulation (per final volume of 100 ml) | |
|---|---|
| water | 75.0 ml |
| sodium tripropylnaphthalenesulfonate (20% aqueous solution) | 8.6 ml |
| sodium dihydrogenorthophosphate dihydrate (5% aqueous solution) | 6.8 ml |
| potassium hydroxide (1 mol/L aqueous solution) | 9.5 ml |
| Organic Polyhalogen Compound "C" (3-tribromomethanesulfonylbenzoylaminoacetic acid) | 4.0 g |

The aqueous solution of Organic Polyhalogen Compound "C" was prepared according to the procedures below.

Under steady stirring, water, 20% aqueous solution of sodium tripropylnaphthalenesulfonate, 5% aqueous solution of sodium dihydrogen-orthophosphate dihydrate, and an 1 mol/L aqueous potassium hydroxide solution were sequentially added, and the mixture was then stirred for 5 minutes. While continuing the stirring, the powder of Organic Polyhalogen Compound "C" was added and homogeneously dissolved until a clear solution is obtained. The obtained aqueous solution was filtered through a 200-mesh polyester screen to thereby remove dust or other foreign matters, and then stored.

preparation of Emulsified Dispersion of Compound "Z"

Ten kilograms of a material containing 85 wt % of Compound "Z" (R-054, product of Sanko K.K.) and 11.66 kg of MIBK (methylisobutyl ketone) were mixed and solubilized for 1 hour at 80° C. under a nitrogen-replaced atmosphere. The obtained solution is then added with 25.52 kg of water, 12.76 kg of a 20 wt % aqueous solution of a modifiedpolyvinyl alcohol (Poval MP-203, product of Kuraray Co., Ltd.) and 0.44 kg of a 20 wt % aqueous solution of sodium triisopropylnaphthalenesulfonate, and subjected to emlsifying dispersion at 20 to 40° C., 3,600 rpm for 60 minutes. The obtained dispersion is further added with 0.08 kg of Surfinol 104E (product of Nissin Chemical Industry Co., Ltd.) and 47.94 kg of water, distilled under reduced pressure to remove MIBK, and adjusted to the concentration of Compound "Z" of 10 wt %. Compound "Z" grains contained in thus obtained dispersion were found to have a median diameter of 0.19 μm, a maximum diameter of 1.5 μm or less, and a coefficient of variation of the grain size of 17%. The obtained dispersion was filtered through a polypropylene filter with a pore size of 3.0 μm to separate dust or other foreign matters and then stored.

Preparation of 6-Isopropylphthalazine Compound Dispersions

While stirring 86.15 g of water at the room temperature, 2.0 g of a modified polyvinyl alcohol (Poval MP-203, product of Kuraray Co., Ltd.) was added thereto so as not to generate agglomerate, and stirred for 10 minutes. The mixture was then heated so as to attain an inner temperature of 50° C., and kept under stirring for 90 minutes to ensure homogeneous dissolution. The inner temperature was lowered to 40° C. or below, added with 3.0 g of a 20% solution of sodium tripropylnaphthalenesulfonate and 7.15 g of a 70% aqueous solution of 6-isopropylphthalazine, and then stirred for 30 minutes, to thereby obtain 100 g of a clear dispersion. The obtained dispersion was filtered through a polypropylene filter with a pore size of 3.0 μm to separate dust or other foreign matters and then stored.

Preparation of Solid Micrograin Dispersion of Nucleation Aid

Four kilograms of Nucleation Aid "Y", 1 kg of polyvinyl alcohol (PVA-217, product of Kuraray Co., Ltd.) and 36 kg of water were mixed and then thoroughly stirred to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 12 hours, added with 4 g of benzoisothiazolinone sodium salt and water so as to adjust the concentration of the nucleation aid to 10 wt %, to thereby obtain a solid microgram dispersion of the nucleation aid. The nucleation aid grains contained in thus obtained dispersion were found to have a median diameter of 0.34 μm, a maximum diameter of 3.0 μm or less, and a coefficient of variation of the grain size of 19%. The obtained dispersion was filtered through a polypropylene filter with a pore size of 3.0 μm to separate dust or other foreign matters and then stored.

Preparation of Solid Micrograin Dispersion of Development Accelerator

Ten kilograms of a development accelerator expressed by the formula (A) in Table 8, 10 kg of a 20 wt % aqueous solution of a modified polyvinyl alcohol (MP-203, product of Kuraray Co., Ltd.) and 20 kg of water were mixed and then thoroughly stirred to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 5 hours, added with water so as to adjust the concentration of the development accelerator to 20 wt %, to thereby obtain a solid microgram dispersion of the development accelerator. The development accelerator grains contained in thus obtained dispersion were found to have a median diameter of 0.5 μm, a maximum diameter of 2.0 μm or less, and a coefficient of variation of the grain size of 18%. The obtained dispersion was filtered through a polypropylene filter with a pore size of 3.0 μm to separate dust or other foreign matters and then stored.

Preparation of Coating Liquid for Image Producing Layer

To the silver behenate dispersion "A" obtained above, added were binder, materials and the silver halide emulsion "A" listed below, and further added with water to obtain a coating liquid for the image producing layer, where all quantities being indicated per mol of silver in the silver behenate dispersion "A". The obtained coating liquid was degassed under a pressure of 0.54 atm for 45 minutes. The coating liquid thus obtained has a pH of 7.3 to 7.7 and a viscosity at 25° C. of 40 to 50 mPa·s.

| | |
|---|---|
| SBR latex binder (Lacstar 3307B, product of Dai-Nippon Ink & Chemicals, Inc., glass transition point = 17° C.) | 397 g as a solid content |
| Reducing Agent "A" | 149 g as a solid content |
| Organic Polyhalogen Compound "A" | 43.6 g as a solid content |
| Organic Polyhalogen Compound "B" | 13.8 g as a solid content |
| Organic Polyhalogen Compound "C" | 2.25 g as a solid content |
| sodium ethylthiosulfonate | 0.47 g |
| benzotriazole | 1.02 g |

-continued

| | | |
|---|---|---|
| polyvinyl alcohol (PVA-235, product of Kuraray Co., Ltd.) | 10.8 | g |
| 6-isopropylphthalazine | 17 | g |
| Compound "Z" | 9.7 | g as a solid content |
| Nucleation Aid "Y" | 15.3 | g |
| Dye "A" (added as dissolved in a solution also containing a low-molecular-weight gelatin having an average molecular weight of 15,000, and used in an amount affording an optical density of 0.15 at 783 nm) | ca. 0.19 | g |
| silver halide emulsion "A" | 0.06 | mol as silver amount |
| Compound "A" (antiseptic) | 40 | ppm in the coating liquid (coated amount = 2.5 mg/m$^2$) |
| methanol | 2 | wt % of the total solvent in the coating liquid |
| ethanol | 1 | wt % of the total solvent in the coating liquid |

(The glass transition point of the coated film was found to be 17° C.)

Compound "Z"

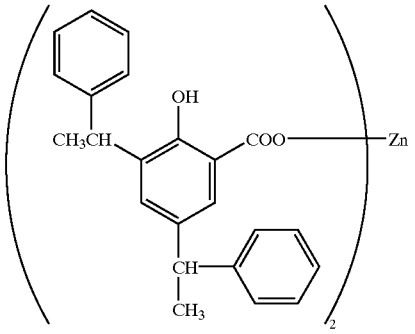

Nucleation Aid "Y"

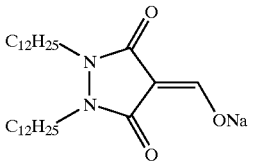

Dye "A"

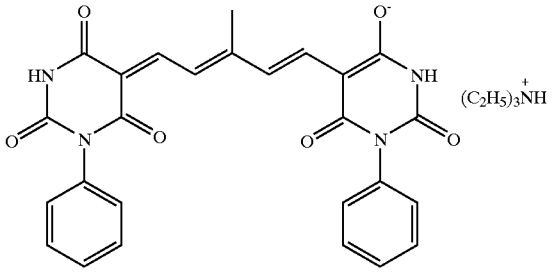

Preparation of Coating Liquid for Lower Protective Layer

Water was added to 943 g of a polymer latex solution of methyl methacrylate/styrene/2-ethylhexyl acrylate/2-hydroxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid=24° C., average grain size=116 nm], and the mixture was further added with 1.62 g of Compound "E", 112.7 g of aqueous solution of Organic Polyhalogen Compound "C", 11.54 g (as a solid content) of Development Accelerator "A", 1.58 g of a matting agent (polystyrene grain, average grain size=7 μm, coefficient of variation of the average grain size=8%), and 29.4 g of polyvinyl alcohol (PVA-235, product of Kuraray Co., Ltd.), and still further added with water, to thereby prepare the coating liquid (final methanol content of 2 wt %). After the preparation, the coating liquid was degassed under a reduced pressure of 0.47 atm for 60 minutes. The coating liquid was found to have a pH of 5.4 and a viscosity at 25° C. of 39 mPa·s.

Preparation of Coating Liquid for Upper Protective Layer

Water was added to 649 g of a polymer latex solution of methyl methacrylate/styrene/2-ethylhexyl acrylate/2-hydroxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid 24° C., average grain size=72 nm], and the mixture was further added with 6.30 g of a 30 wt % solution of carnauba wax (Cellosol 524, silicone content <5 ppm, product of Chukyo Oil and Fat, Ltd.), 0.23 g of Compound "C", 0.93 g of Compoune "E", 7.95 g of Compound "F", 1.8 g of Compound "H", 1.18 g of a matting agent (polystyrene grain, average grain size=7 μm, coefficient of variation of the average grain size 8%), and 12.1 g of polyvinyl alcohol (PVA-235, product of Kuraray Co., Ltd.), and still further added with water, to thereby prepare the coating liquid (final methanol content of 1.5 wt %). After the preparation, the coating liquid was degassed under a reduced pressure of 0.47 atm for 60 minutes. The coating liquid was found to have a pH of 2.8 and a viscosity at 25° C. of 30 mPa·s. to have a pH of 2.8 and a viscosity at 25° C. of 30 mPa·s.

Compound "C"

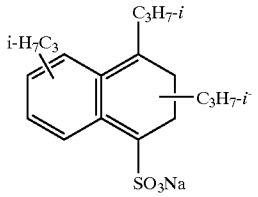

Compound "D"

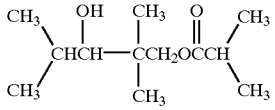

Compound "E"

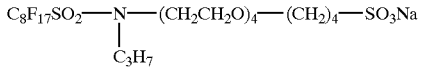

Compound "F"

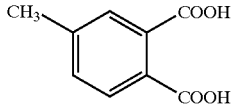

-continued

Compound "H"

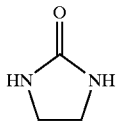

Fabrication of Polyethylene Terephthalate (PET) Support Having Back/Undercoat Layer (1) Fabrication of PET Support PET with an intrinsic viscosity of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted unstretched film so as to have a thickness of 120 μm after heat setting.

The film was then stretched in the moving direction 3.3 times at 110. C. using rollers different in the peripheral speed and then transversely stretched 4.5 times at 130. C. using a tenter. Subsequently, the film was heat-set at 240. C. for 20 seconds, and then relaxed by 4% in the transverse direction at the same temperature. Thereafter, a portion chucked by the tenter was slit off and the film was knurled at both edges and then wound up under a tension of 4.8 kg/cm$^2$. Thus, a rolled support of 2.4 m wide, 3,500 m long and 120 μm thick was fabricated.

(2) Formation of Undercoat Layer and Back Layers (2-1) First Undercoat Layer

The PET support thus obtained is subjected to corona discharge treatment at 0.375 kV·A·min/m$^2$, a coating liquid having a composition shown below was coated on the support in an amount of 6.2 ml/m$^2$, and was stepwisely dried at 125° C. for 30 seconds, at 150° C. for 30 seconds and at 185° C. for 30 seconds.

| | |
|---|---|
| Latex-A | 280 g |
| KOH | 0.5 g |
| polystyrene grain (average grain size = 2 μm, coefficient of variation of the average grain size = 7%) | 0.03 g |
| 2,4-dichloro-6-hydroxy-s-triazine | 1.8 g |
| Compound-Bc-C | 0.097 g |
| distilled water amount for adjusting total weight to | 1,000 g |

(2-2) Second Undercoat Layer

A coating liquid having a composition shown below was coated on the first undercoat layer in an amount of 5.5 ml/m$^2$, and was stepwisely dried at 125° C. for 30 seconds, at 150° C. for 30 seconds and at 170° C. for 30 seconds.

| | |
|---|---|
| deionized gelatin ($Ca^{2+}$ content = 0.6 ppm, jelly strength = 230 g) | 10 g |
| acetic acid (20% aqueous solution) | 10 g |
| Compound-Bc-A | 0.04 g |
| methyl cellulose (2% aqueous solution) | 25 g |
| polyethylene oxy compound | 0.3 g |
| distilled water amount for adjusting total grain to | 1,000 g |

(2-3) First Back Layer

The side of the PET support opposite to that having the undercoat layer was subjected to corona discharge treatment at 0.375 kV·A·minute/m$^2$, and a coating liquid having a composition shown below was coated on the treated side in an amount of 13.8 ml/m$^2$, which was then stepwisely dried at 125° C. for 30 seconds, at 150° C. for 30 seconds and at 185° C. for 30 seconds.

| | |
|---|---|
| Jurimer ET-410 (30% water-base dispersion, product of Nippon Jun'yaku K. K.) | 23 g |
| alkali-treated gelatin (molecular weight of ca. 10,000, $Ca^{2+}$ content = 30 ppm) | 4.44 g |
| deionized gelatin ($Ca^{2+}$ content = 0.6 ppm) | 0.84 g |
| Compound-Bc-A | 0.02 g |
| Dye-Bc-A (used in an amount affording an optical density of 1.3 to 1.4 at 783 nm) | ca. 0.88 g |
| polyoxyethylenephenyl ether | 1.7 g |
| Sumitex Resin M-3 (8% aqueous solution of water-soluble melamine compound, product of Sumitomo Chemical) | 15 g |
| FS-10D (water-base dispersion of Sb-doped acicular $SnO_2$ grain, product of Ishihara Sangyo Kaisha, Ltd.) | 24 g |
| polystyrene grain (average grain size = 2 μm, coefficient of variation of the average grain size = 7%) | 0.03 g |
| distilled water amount for adjusting total weight to | 1,000 g |

(2-4) Second Back Layer

A coating liquid having a composition shown below was coated on the first back layer in an amount of 5.5 ml/m$^2$, and was stepwisely dried at 125° C. for 30 seconds, at 150° C. for 30 seconds and at 170° C. for 30 seconds.

| | |
|---|---|
| Jurimer ET-410 (30% water-base dispersion, product of Nippon Jun'yaku K K) | 57.5 g |
| polyoxyethylenephenyl ether | 1.7 g |
| Sumitex Resin M-3 (8% aqueous solution of water-soluble melamine compound, product of Sumitomo Chemical) | 15 g |
| Cellosol 524 (30% aqueous solution, product of Chukyo Oil and Fat, Ltd.) | 6.6 g |
| distilled water amount for adjusting total weight to | 1,000 g |

(2-5) Third Back Layer

A coating liquid same as that for the first under coat layer was coated on the second back layer in an amount of 6.2 ml/m$^2$, and was stepwisely dried at 125° C. for 30 seconds, at 150° C. for 30 seconds and at 185° C. for 30 seconds.

(2-6) Fourth Back Layer

A coating liquid having a composition shown below was coated on the third back layer in an amount of 13.8 ml/m$^2$, and was stepwisely dried at 125° C. for 30 seconds, at 150° C. for 30 seconds and at 170° C. for 30 seconds.

| | |
|---|---|
| Latex-B | 286 g |
| Compound-Bc-B | 2.7 g |
| Compound-Bc-C | 0.6 g |
| Compound-Bc-D | 0.5 g |
| 2,4-dichloro-6-hydroxy-s-triazine | 2.5 g |
| polymethyl methacrylate (10% water-base dispersion, average grain size = 5 μm, coefficient of variation of the average grain size = 7%) | 7.7 g |
| distilled water | amount for adjusting total weight to 1,000 g |

-continued

Dye-Bc-A

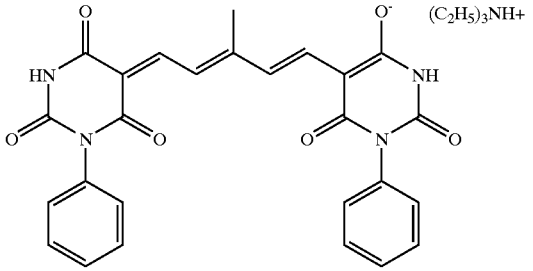

Compound-Bc-A

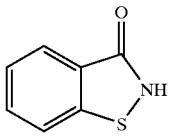

Compound-Bc-B
$C_{18}H_{37}OSO_3Na$
Compound-Bc-C
$C_8F_{17}SO_3Li$
Compound-Bc-D
$C_8F_{17}SO_2—N(C_4H_9)—(CH_2CH_2O)_4—(CH_2)_4—SO_3Na$ Latex-A
Core/shell type latex, core/shell=90/10 (ratio in wt %)
core portion: vinylidene chloride/methyl acrylate/methyl methacrylate/acrylonitrile/acrylic acid=93/3/3/0.9/0.1 (wt %)
shell portion: vinylidene chloride/methyl acrylate/methyl methacrylate/acrylonitrile/acrylic acid=88/3/3/3/3 (wt %), weight average molecular weight=38,000
Latex-B
copolymer of methyl methacrylate/styrene/2-ethyhexyl acrylate/2-hydroxyethyl methacrylate/acrylic acid=59/9/26/5/1 (wt %)

(3) Annealing Under Conveyance (3-1) Annealing

Thus obtained PET support provided with the back layer and undercoat layer were introduced into an annealing zone of 200 m long set at 160° C., and conveyed at a tension of 2 kg/cm$^2$ and a conveyance rate of 20 m/minute.

(3-2) Post Annealing

Following the foregoing annealing, the PET support was post-annealed by passing through a 40° C. zone for 15 seconds and was wound up into a roll at a winding tension of 10 kg/cm$^2$.

Fabrication of Photothermographic Material

On the undercoat layer, which comprises the lower and upper undercoat layers formed on the support, the above described coating liquid for the image producing layer was coated so as to attain a coated silver amount of 1.5 g/m$^2$ using the slide bead coating method as shown in FIG. 1 of JP-A-2000-2964. Further thereon, the foregoing coating liquid for the lower protective layer was coated by the simultaneous multi-layer coating method with the coating liquid for the image producing layer so as to attain a coated solid amount of the polymer latex of 1.31 g/m$^2$. Still further thereon, the foregoing coating liquid for the upper protective layer was coated so as to attain a coated solid amount of the polymer latex of 3.11 g/m$^2$, to thereby fabricate the photothermographic material.

Drying during the coating was effected, both in the constant-rate and falling-rate periods, at a dry bulb temperature of 70 to 75° C., a dew point of 8 to 25° C., a liquid film surface temperature of 35 to 40° C. in a horizontal drying zone (keeping the support within inclination of 1.5 to 3° from the horizontal level of the coater). Winding after the drying was performed at 25±5° C. under a relative humidity of 45±10% so as to orient the image producing side outward corresponding to the orientation in the later processing. A humidity in the package for the photosensitive material was adjusted to 20 to 40% (measured at 25° C.), the film surface of the image-producing side thereof was found to have a pH of 5.0 and a Bekk smoothness of 850 seconds, and the film surface of the opposite side was found to have a pH of 5.9 and a Bekk smoothness of 560 seconds.

Evaluation of Photographic Property (Exposure)

The obtained photothertgraphic samples were exposed using a laser exposure apparatus of single-channel inner cylinder surface scanning type, provided with a semiconductor laser device having a beam spot size (FWHM at half beam intensity) of 12.56 $\mu$m, a laser output of 50 mW and an output wavelength of 783 nm at various numbers of rotation of the mirror and for exposure periods listed in Table 8. The exposure was proceeded at an overlap coefficient of 0.449 and an irradiation energy from 20 to 100 $\mu$J/cm$^2$.

(Heat Development)

The photothermographic material after the exposure was heat-developed using a heat developing apparatus shown in FIG. 1, in which the roller surface being composed of silicone rubber, the smooth plane being composed of a non-woven Teflon (product name of tetrafluoroethylene) fabric. Line speeds of the conveyance are listed in Table 8, where in an exemplary case with a line speed of 150 cm/min, the heat development was proceeded in the preheating section for 12.2 seconds (independent drive systems for the preheating section and developing section, difference in the line speed with respect to the developing section suppressed to −0.5 to −1%, set temperatures and process times for the individual metal rollers in the preheating section are 67° C. and 2.0 seconds for a first roller, 82° C. and 2.0 seconds for a second roller, 98° C. and 2.0 seconds for a third roller, 107° C. and 2.0 seconds for a fourth roller, 115° C. and 2.0 seconds for a fifth roller, and 120° C. and 2.0 seconds for a sixth roller), in the heat developing section at 120° C. (surface temperature of the photothermographic material) for 17.2 seconds, and in the slow cooling section for 13.6 seconds. Here, the process time varies depending on the line speed. Temperature accuracy in the width direction was found to be ±0.50° C. The width of each roller was set wider by 5 cm each from both edges of the photothermographic material (of 61 cm wide for example), and each roller was heated over the entire width so as to ensure a required temperature accuracy. More specifically, temperature of both edge portions of each roller projected by 5 cm each from both edges of the photothermographic material was set higher by 1 to 3° C. than that of the central portion so as to ensure uniform image density on the photothermographic material (over a width of 61 cm for example), since both edge portions of the roller tend to be lowered in a considerable degree.

(Evaluation of Photographic Properties)

Obtained image was evaluated using Macbeth TD904 densitometer (visible density). Results of the measurement were evaluated by $D_{min}$ (fog), $D_{max}$ (maximum density) and sensitivity [an inverse of a ratio of exposure energies giving $D_{min}$ and ($D_{min}$ plus 1.5), expressed in a relative value assuming a value for Sample 1 in Table 8 as 100]. The exposure energy dependence of the line width sensitivity herein was measured with doubled exposure energy of the standard exposure energy.

TABLE 8

| | | Compound of formula (A) | | Exposure conditions | | | Photographic properties | | | | |
|---|---|---|---|---|---|---|---|---|---|---|---|
| Sample No. | Nucleation aid employed | Compound No. | Amount of addition ($mg/m^2$) | Number of rotation (rpm) | Exposure period (sec) | Line speed (cm/min) | $D_{min}$ | Sensitivity | $D_{max}$ | Line width variation | Remarks |
| 1 | yes | — | — | 36,000 | $2.0 \times 10^{-8}$ | 127 | 0.12 | 100 | 4.1 | 12 | comparison |
| 2 | no | — | — | 36,000 | $2.0 \times 10^{-8}$ | 127 | 0.12 | 60 | 2.0 | 5 | comparison |
| 3 | no | A-55 | 70 | 36,000 | $2.0 \times 10^{-8}$ | 127 | 0.12 | 65 | 2.4 | 5 | comparison |
| 4 | yes | A-55 | 70 | 36,000 | $2.0 \times 10^{-8}$ | 127 | 0.13 | 140 | 4.0 | 14 | comparison |
| 5 | yes | A-55 | 70 | 36,000 | $2.0 \times 10^{-8}$ | 140 | 0.11 | 114 | 4.2 | 6 | invention |
| 6 | yes | A-55 | 70 | 36,000 | $2.0 \times 10^{-8}$ | 150 | 0.11 | 102 | 4.1 | 5 | invention |
| 7 | yes | A-55 | 70 | 36,000 | $2.0 \times 10^{-8}$ | 160 | 0.10 | 90 | 4.0 | 3 | invention |
| 8 | yes | A-55 | 70 | 60,000 | $1.2 \times 10^{-8}$ | 150 | 0.11 | 101 | 4.1 | 5 | invention |
| 9 | yes | A-2 | 55 | 36,000 | $2.0 \times 10^{-8}$ | 150 | 0.11 | 100 | 4.0 | 4 | invention |
| 10 | yes | A-2 | 55 | 60,000 | $1.2 \times 10^{-8}$ | 150 | 0.11 | 100 | 4.0 | 4 | invention |

It is clear from Table 8 that low fog (sufficient image density ($D_{max}$) and small line width variation can be achieved for the samples using the development accelerator expressed by the formula (A) and heat-developed at a line speed of 140 cm/min or faster.

Example 2

Fabrication of Photothermographic Material

Similarly to Example 1, the coating liquids for the image producing layer and lower protective layer were coated on the PET support by the simultaneous multi-layer coating. Further thereon the two following coating liquids for the intermediate protective layer and top protective layer were coated on the lower protective layer also by the simultaneous multi-layer coating so as to attain the coated amount of solid content of 1.97 $g/m^2$ and 1.07 $g/m^2$, respectively, to thereby obtain a photothermographic material.

Preparation of Coating Liquid for Intermediate Protective Layer

A coating liquid for the intermediate protective layer was prepared by mixing 625 g of methyl methacrylate/styrene/2-ethylhexyl acrylate/2-hydroxyethyl methacrylate/acrylic acid copolymer latex [copolymerization ratio by weight of 58.9/8.6/25.4/5.1/2, glass transition point=46° C. (estimation), solid content=21.5%, containing 100 ppm of Comound "A", containing Compound "D" as a filming aid in an amount of 15 wt % of the solid content of the latex, glass transition point of the coating liquid=24° C., average grain size=72 nm] with water, and by further adding 0.23 g of Compound "C", 0.13 g of Compound "E", 12.1 g of Compound "F", 2.75 g of compound "H", and 11.5 g of polyvinyl alcohol (PVA-235, product of Kuraray Co., Ltd.), and by still further adding water, to thereby prepare the coating liquid (final methanol content of 0.5 wt %). After the preparation, the coating liquid was degassed under a reduced pressure of 0.47 atm for 60 minutes. The coating liquid was found to have a pH of 2.6 and a viscosity at 25° C. of 50 mPa·s.

Preparation of Coating Liquid for Top Protective Layer

A coating liquid for the top protective layer was prepared by mixing 649 g of methyl methacrylate/styrene/2-ethylhexyl acrylate/2-hydroxyethyl methacrylate/acrylic acid copolymer latex [copolymerization ratio by weight of 58.9/8.6/25.4/5.1/2, glass transition point=46° C. (estimation), solid content=21.5%, containing 100 ppm of Comound "A", containing compound "D" as a filming aid in an amount of 15 wt % of the solid content of the latex, glass transition point of the coating liquid=24° C., average grain size=116 nm] with water, and by further adding 0.23 g of Compound "C", 1.85 g of Compound "E", 1.0 g of Compound "G", 18.4 g of a 30 wt % solution of carnauba wax (Cellosol 524, silicone content <5 ppm, product of Chukyo Oil and Fat, Ltd.), 3.45 g of a matting agent (polystyrene grain, average grain size=7 μm, coefficient of variation of the average grain size=8%), and 26.5 g of polyvinyl alcohol (PVA-235, product of Kuraray Co., Ltd.), and by still further adding water, to thereby prepare the coating liquid (final methanol content of 3 wt %). After the preparation, the coating liquid was degassed under a reduced pressure of 0.47 atm for 60 minutes. The coating liquid was found to have a pH of 5.2 and a viscosity at 25° C. of 24 mPa·s.

Each of the obtained photothermographic materials was evaluated similarly to Example 1, and results almost equivalent to those in Example 1 were reproduced. That is, low fog ($D_{min}$), sufficient image density ($D_{max}$) and small line width variation were achieved for the samples using the development accelerator expressed by the formula (A) and heat-developed at a line speed of 140 cm/min or faster.

Example 3

Samples obtained in Example 1 were exposed using a multi-channel exposure apparatus based on the outer cylinder surface scanning system (equipped with 30 semiconductor laser heads of 50 mW output), and heat-developed similarly to Example 1. The samples of the present invention was proven to give low fog ($D_{min}$), sufficient image density ($D_{max}$) and small line width variation.

Example 4

The photothermographic materials were fabricated and evaluated similarly to Example 1 except that using the following materials.

Preparation of Solid Microgram Dispersion of Organic Polyhalogen Compound "D"

Ten kilograms of Organic Polyhalogen Compound "D" [N-butyl-3-tribromomethanesulfonylbenzamide], 10 kg of a 20 wt % aqeous solution of a modified polyvinyl alcohol (Poval MP-203, product of Kuraray Co., Ltd.), 400 g of a 20 wt % aqueous solution of sodium triisopropylnaphthalenesulfonate and 13 kg of water were mixed thoroughly to prepare a slurry. The slurry was then fed with the aid of a diaphragm pump to a lateral sand mill (UVM-2 manufacturedby Aimex, Ltd.) packed with zirconia bead with an average diameter of 0.5 mm, dispersed for 7 hours, added with 4.0 g of benzoisothiazolinone sodium salt and water so as to adjust the concentration of Organic Polyhalogen Compound "D"to 25 wt %, to obtain a solid microgram dispersion of Organic Polyhalogen Compound "D". Organic polyhalogen compound grains contained in thus obtained dispersion were found to have a median diameter of 0.35 μm, a maximum diameter of 2.0 μm or less, and a coefficient of variation of the average grain size of 20%. The obtained dispersion was filtered through a polypropylene filter with a pore size of 3.0 μm to separate dust or other foreign matters and then stored.

Besides the above-described dispersion, dispersions of Compounds "E", "F" and "G" were also prepared similarly to the process of preparing the solid microgram dispersion of Organic Polyhalogen Compound "A" in Example 1, by replacing Organic Polyhalogen Compound "A" with an equal weight of Compounds "E", "F" or "G".

Organic Polyhalogen Compound "E"

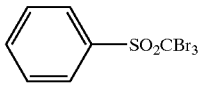

Organic Polyhalogen Compound "F"

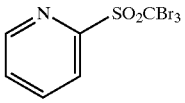

Organic Polyhalogen Compound "G"

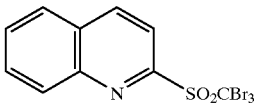

Preparation of Aqueous Solution of Organic Polyhalogen Compound "H"

Under steady stirring, 75.0 ml of water, 8.6 g of a 20% aqueous solution of sodium tripropylnaphthalenesulfonate, 6.8 ml of a 5% aqueous solution of sodium dihydrogenorthophosphate dihydrate, and 9.7 ml of an 1 mol/L aqueous potassium hydroxide solution were sequentially added, and the mixture was then stirred for 5 minutes. While continuing the stirring, 4.0 g of the powder of organic Polyhalogen Compound "H", or [3-tribromo-methanesulfonylbenzoylaminoacetic acid], was added and homogeneously dissolved until a clear solution is obtained. The obtained aqueous solution was filtered through a 200-mesh polyester screen to thereby remove dust or other foreign matters, and then stored.

Preparation of 6-Isopropylphthalazine Compound Dispersion

While stirring 62.35 g of water at the room temperature, 2.0 g of a modified polyvinyl alcohol (Poval MP-203, product of Kuraray Co., Ltd.) was added thereto so as not to generate agglomerate, and stirred for 10 minutes. The inner temperature was lowered to 40° C. or below, and the solution was further added with 25.5 g of a 10% aqueous solution of polyvinyl alcohol (PVA-217, product of Kuraray Co., Ltd.), 3.0 g of a 20% solution of sodium tripropylnaphthalenesulfonate and 7.15 g of a 70% aqueous solution of 6-isopropylphthalazine, and then stirred for 30 minutes, to thereby obtain 100 g of a clear dispersion. The obtained dispersion was filtered through a polypropylene filter with a pore size of 3.0 μm to separate dust or other foreign matters and then stored.

Preparation of Solid Micrograin Dispersion of Development Accelerator

Ten kilograms of Development Accelerator "A-55" described elsewhere in the above, 20 kg of a 10 wt % aqueous solution of a modified polyvinyl alcohol (MP-203, product of Kuraray Co., Ltd.) and 20 kg of water were mixed and then thoroughly stirred to prepare a slurry. The slurry was then fed with the aid of a diaphragm pump to a lateral sand mill (UVM-2 manufactured by Aimex, Ltd.) packed with zirconia bead with an average diameter of 0.5 mn, dispersed for 12 hours, added with water so as to adjust the concentration of Development Accelerator "A-55" to 22.5 wt %, to thereby obtain a solid microgram dispersion of the Development Accelerator "A-55". The "A-55" grains contained in thus obtained dispersion were found to have a median diameter of 0.38 μm, a maximum diameter of 2.0 μm or less, and a coefficient of variation of the grain size of 18%. The obtained dispersion was filtered through a polypropylene filter with a pore size of 3.0 μm to separate dust or other foreign matters and then stored.

Preparation of Coating Liquid for Image Producing Layer

To the silver behenate dispersion "A" obtained above, added were binder, materials and the silver halide emulsion "A" listed below, and further added with water to obtain a coating liquid for the image producing layer, where all quantities being indicated per mol of silver in the silver behenate dispersion "A". The obtained coating liquid was degassed under a pressure of 0.54 atm for 45 minutes. The coating liquid thus obtained has a pH of 7.3 to 7.7 and a viscosity at 25° C. of 40 to 50 mPa·s.

| | |
|---|---|
| SBR latex binder<br>(Lacstar 3307B, product of Dai-Nippon Ink & Chemicals, Inc., glass transition point = 17° C.) | 397 g as a solid content |
| Reducing Agent "A" | 149 g as a solid content |
| Organic Polyhalogen Compound | species and amount of use listed in Table 9 |
| benzotriazole | 1.02 g |
| polyvinyl alcohol<br>(PVA-235, product of Kuraray Co., Ltd.) | 10.8 g |
| 6-isopropylphthalazine | 17 g |
| Compound "Z" | 9.7 g as a solid content |
| Nucleation Aid "Y" | 15.3 g |
| Dye "A"<br>(added as dissolved in a solution also containing a low-molecular-weight gelatin having an average molecular weight of 15,000, and used in an amount affording an optical density of 0.15 at 783 nm) | ca. 0.19 g |
| silver halide emulsion "A" | 0.06 mol as silver amount |

-continued

| | |
|---|---|
| Compound "A" (antiseptic) | 40 ppm in the coating liquid (coated amount = 2.5 mg/m$^2$) |
| methanol | 2 wt % of the total solvent in the coating liquid |
| ethanol | 1 wt % of the total solvent in the coating liquid |
| (The glass transition point of the coated film was found to be 17° C.) | |

Preparation of Coating Liquid for Lower Protective Layer

Water was added to 943 g of a polymer latex solution of methyl methacrylate/styrene/2-ethylhexyl acrylate/2-hydroxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid=24° C., average grain size=116 nm], and the mixture was further added with 1.62 g of Compound "E", organic Polyhalogen Compound (species and amount of which listed in Table 9), 11.54 g (as a solid content) of Development Accelerator "A", 1.58 g of a matting agent (polystyrene grain, average grain size=7 μm, coefficient of variation of the average grain size=8%), and 29.4 g of polyvinyl alcohol (PVA-235, product of Kuraray Co., Ltd.), and still further added with water, to thereby prepare the coating liquid (final methanol content of 2 wt %). After the preparation, the coating liquid was degassed under a reduced pressure of 0.47 atm for 60 minutes. The coating liquid was found to have a pH of 5.4 and a viscosity at 25° C. of 45 mPa·s.

Preparation of Coating Liquid for Upper Protective Layer

Water was added to 649 g of a polymer latex solution of methyl methacrylate/styrene/2-ethylhexyl acrylate/2-hydroxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid=24° C., average grain size=72 nm], and the mixture was further added with 6.30 g of a 30 wt % solution of carnauba wax (Cellosol 524, silicone content <5 ppm, product of Chukcyo Oil and Fat, Ltd.), 0.23 g of Compound "C", 0.93 g of Compoune "E", 7.95 g of Compound "F", 1.8 g of Compound "H", 1.18 g of a matting agent (polystyrene grain, average grain size=7 μm, coefficient of variation of the average grain size=8%), and 12.1 g of polyvinyl alcohol (PVA-235, product of Kuraray Co., Ltd.), and still further added with water, to thereby prepare the coating liquid (final methanol content of 1.5 wt %). After the preparation, the coating liquid was degassed under a reduced pressure of 0.47 atm for 60 minutes. The coating liquid was found to have a pH of 2.8 and a viscosity at 25° C. of 30 mPa·s.

Evaluation

Photographic properties of thus obtained photothermographic materials were evaluated similarly to Example 1, except that the light exposure was effected with the number of mirror rotation of 36,000 rpm and an exposure time of $2.0\times10^{-8}$ seconds. In the evaluation of photographic properties, results were expressed in a relative manner assuming the result of sample No. 22 in Table 9 as 100. Storability was evaluated as described below.

Evaluation of Storability

The obtained photosensitive mnaterials were allowed to stand at 25° C. and a relative humidity of 40% for 3 hours, stacked so that the photosensitive layer and back layer thereof are opposed, and kept in a tightly sealed environment at 35° C., and were then developed as described in the above. Photographic properties were evaluated as described in the above.

TABLE 9

| | | Image producing layer | | Lower protective layer | | | Photographic properties | | | | Storability | | | |
|---|---|---|---|---|---|---|---|---|---|---|---|---|---|---|
| | Compound of | Polyhalogen compound | | Polyhalogen compound | | | | | | Line width | | | Line width | |
| Sample No. | formula (A) employed | No. | Amount of addition (mol/m$^2$) | No. | Amount of addition (mol/m$^2$) | Line speed (cm/min) | $D_{min}$ | Sensitivity | $D_{max}$ | variation (μm) | $D_{min}$ | Sensitivity | variation (μm) | Remarks |
| 21 | yes | B | $1.1\times10^{-3}$ | A | $2.0\times10^{-4}$ | 127 | 0.14 | 141 | 4.1 | 15 | 0.16 | 148 | 17 | comparison |
| | | G | $6.6\times10^{-6}$ | G | $6.2\times10^{-5}$ | | | | | | | | | |
| 22 | no | B | $1.1\times10^{-3}$ | A | $2.0\times10^{-4}$ | 127 | 0.11 | 100 | 4.1 | 12 | 0.11 | 102 | 12 | comparison |
| | | G | $6.6\times10^{-5}$ | G | $6.2\times10^{-5}$ | | | | | | | | | |
| 23 | yes | B | $1.5\times10^{-3}$ | A | $3.0\times10^{-4}$ | 140 | 0.12 | 123 | 4.2 | 9 | 0.14 | 129 | 10 | Invention |
| 24 | yes | B | $1.1\times10^{-3}$ | A | $2.0\times10^{-4}$ | 140 | 0.11 | 115 | 4.1 | 6 | 0.12 | 115 | 7 | Invention |
| | | G | $6.6\times10^{-5}$ | G | $6.2\times10^{-5}$ | | | | | | | | | |
| 25 | yes | A | $6.6\times10^{-4}$ | A | $1.5\times10^{-4}$ | 160 | 0.12 | 115 | 4.0 | 7 | 0.13 | 123 | 8 | Invention |
| | | B | $6.6\times10^{-4}$ | B | $1.5\times10^{-4}$ | | | | | | | | | |
| 26 | yes | B | $1.1\times10^{-3}$ | B | $2.0\times10^{-4}$ | 160 | 0.11 | 107 | 4.0 | 5 | 0.11 | 107 | 5 | Invention |
| | | C | $6.6\times10^{-5}$ | C | $6.2\times10^{-5}$ | | | | | | | | | |
| 27 | yes | B | $1.1\times10^{-3}$ | A | $2.0\times10^{-4}$ | 160 | 0.10 | 107 | 4.0 | 4 | 0.11 | 107 | 4 | Invention |
| | | C | $6.6\times10^{-5}$ | C | $6.2\times10^{-5}$ | | | | | | | | | |

TABLE 9-continued

| Sample No. | Compound of formula (A) employed | Image producing layer: Polyhalogen compound No. | Image producing layer: Polyhalogen compound Amount of addition (mol/m$^2$) | Lower protective layer: Polyhalogen compound No. | Lower protective layer: Polyhalogen compound Amount of addition (mol/m$^2$) | Line speed (cm/min) | Photographic properties: $D_{min}$ | Photographic properties: Sensitivity | Photographic properties: $D_{max}$ | Photographic properties: Line width variation ($\mu$m) | Storability: $D_{min}$ | Storability: Sensitivity | Storability: Line width variation ($\mu$m) | Remarks |
|---|---|---|---|---|---|---|---|---|---|---|---|---|---|---|
| 28 | yes | B<br>G | $1.1 \times 10^{-3}$<br>$6.6 \times 10^{-5}$ | A<br>G | $2.0 \times 10^{-4}$<br>$6.2 \times 10^{-5}$ | 160 | 0.10 | 110 | 4.1 | 4 | 0.10 | 110 | 4 | Invention |
| 29 | yes | D<br>G | $1.6 \times 10^{-3}$<br>$6.6 \times 10^{-5}$ | A<br>G | $2.0 \times 10^{-4}$<br>$6.2 \times 10^{-5}$ | 160 | 0.11 | 115 | 4.0 | 6 | 0.12 | 115 | 6 | Invention |
| 30 | yes | E<br>G | $1.3 \times 10^{-3}$<br>$6.6 \times 10^{-5}$ | A<br>G | $2.0 \times 10^{-4}$<br>$6.2 \times 10^{-5}$ | 160 | 0.11 | 110 | 4.0 | 5 | 0.12 | 110 | 5 | Invention |
| 31 | yes | F<br>G | $1.1 \times 10^{-3}$<br>$6.6 \times 10^{-5}$ | A<br>G | $2.0 \times 10^{-4}$<br>$6.2 \times 10^{-5}$ | 160 | 0.11 | 110 | 4.0 | 5 | 0.12 | 110 | 5 | Invention |

As is clear from Table 9, Sample Nos. 21 and 22 processed at a line speed of 127 cm/min showed a large line width variation. On the contrary, Sample Nos. 23 to 31 of the present invention showed low fog ($D_{min}$), sufficient image density ($D_{max}$) and small line width variation. Among these, Sample Nos. 24 and 26 to 31 were especially low in fog both before and after the storage, and in the line width variation.

Example 5

Fabrication of Photothermographic Material

The coating liquids for the image producing layer and lower protective layer, both of which described in Example 4, were coated on the PET support by the simultaneous multi-layer coating similarly to Example 4. Further thereon the coating liquids for the intermediate protective layer and top protective layer, both of which described in Example 2, were coated on the lower protective layer also by the simultaneous multi-layer coating so as to attain the coated amount of solid content of 1.97 g/m$^2$ and 1.07 g/m$^2$, respectively, to thereby obtain a photothermographic material.

Each of the obtained photothermographic materials was evaluated similarly to Example 4, and results almost equivalent to those in Example 4 were reproduced. That is, low fog ($D_{min}$), sufficient image density ($D_{max}$) and small line width variation were achieved for the samples using the development accelerator and two species of the organic polyhaloqen compounds and heat-developed at a line speed of 140 cm/min or faster.

Example 6

Samples obtained in Example 4 were exposed using a multi-channel exposure appratus based on the outer cylinder surface scanning system (equipped with 30 semiconductor laser heads of 50 mW output), and heat-developed similarly to Example 4. The samples of the present invention was proven to give low fog ($D_{min}$) sufficient image density ($D_{max}$) and small line width variation.

What is claimed is:

1. A method for producing an image comprising a step for heat-developing after light exposure a photothermographic material comprising a support, a non-photosensitive organic acid silver salt, a photosensitive silver halide, a nucleation aid, a binder and at least one compound represented by the formula (A) below, at a line speed of 140 cm/min or faster:

(A)

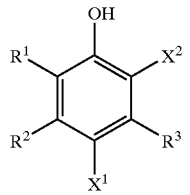

where $R^1$, $R^2$, $R^3$, $X^1$ and $X^2$ independently represent a hydrogen atom, halogen atom, or a substituent which is a carbon atom, oxygen atom, nitrogen atom, sulfur atom or phosphorus atom which is bound to the benzene ring in the above formula;

at least either one of $X^1$ and $X^2$ is a group represented by —$NR^4R^5$, where $R^4$ and $R^5$ independently represents a hydrogen atom, alkyl group, alkenyl group, alkynyl group, aryl group or a group selected from the group consisting of —C(=O)—$R^6$, —C(=O)—C(=O)—$R^6$, —$SO_2$—$R^6$, —SO—$R^6$ and —P(=O)(—$R^6$)—$R^7$, and where $R^6$ and $R^7$ independently represent a hydrogen atom, alkyl group, alkenyl group, alkynyl group, aryl group, heterocyclic group, amino group, hydroxyl group, alkoxy group and aryloxy group; and adjacent substituents $R^4$ and $R^5$ may bind with each other to form a ring and adjacent substituents $R^6$ and $R^7$ may bind with each other to form a ring.

2. The method for producing an image as claimed in claim 1, wherein the photothermographic material further comprises two or more compounds represented by the formula (1) below:

$$Q—(Y)_n—C(Z^1)(Z^2)X \quad (1)$$

where Q represents an alkyl group, aryl group or heterocyclic group, all of which may further have a substituent; Y represents a bivalent linking group; n represents 0 or 1; $Z^1$ and $Z^2$ independently represent a halogen atom; and X represents a hydrogen atom or electron attractive group.

3. The method for producing an image as claimed in claim 1, wherein the photothermographic material is heat-developed at a line speed of 140 cm/min to 700 cm/min.

4. The method for producing an image as claimed in claim 1, wherein the light exposure is effected for $10^{-15}$ seconds to $10^{-7}$ seconds and at an exposure energy of 5 $\mu$J/cm$^2$ to 1 m J/cm$^2$.

5. The method for producing an image as claimed in claim 1, wherein the light exposure is effected using a multi-beam exposing apparatus provided with two or more laser heads.

6. The method for producing an image as claimed in claim 1, wherein the photosensitive silver halide and binder are contained in a image producing layer of the photothermographic material, and 50 wt % or more of the binder is composed of a polymer latex having a glass transition point of −30° C. to 40° C.

7. A high-speed photothermographic material comprising a support, a non-photosensitive organic acid silver salt, a photosensitive silver halide, a nucleation aid, a reducing agent, a binder and at least one compound represented by the formula (A) below:

(A)

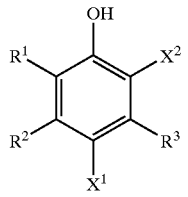

wherein $R^1$, $R^2$, $R^3$, $X^1$ and $X^2$ independently represent a hydrogen atom, halogen atom, or a substituent which is a carbon atom, oxygen atom, nitrogen atom, sulfur atom or phosphorus atom is bound to the benzene ring in the above formula;

at least either one of $X^1$ and $X^2$ is a group represented by $—NR^4R^5$, where $R^4$ and $R^5$ independently represents a hydrogen atom, alkyl group, alkenyl group, alkynyl group, aryl group or a group selected from the group consisting of $—C(=O)—R^6$, $—C(=O)—C(=O)—R^6$, $—SO_2—R^6$, $—SO—R^6$ and $—P(=O)(—R^6)—R^7$, and where $R^6$ and $R^7$ independently represent a hydrogen atom, alkyl group, alkenyl group, alkynyl group, aryl group, heterocyclic group, amino group, hydroxyl group, alkoxy group and aryloxy group; adjacent substituents $R^4$ and $R^5$ may bind with each other to form a ring and adjacent substituents $R^6$ and $R^7$ may bind with each other to form a ring; and two or more compounds as represented by the formula (1) below:

$$Q—(Y)_n—C(Z^1)(Z^2)X \quad (1)$$

where Q represents an alkyl group, aryl group or heterocyclic group, all of which may further have a substituent; Y represents a bivalent linking group; n represents 0 or 1; $Z^1$ and $Z^2$ independently represent a halogen atom; and X represents a hydrogen atom or electron attractive group.

8. The high-speed photothermographic material as claimed in claim 7, wherein the substituent for Q of at least one of the compounds represented by the formula (1) is an electron attractive group.

9. The high-speed photothermographic material as claimed in claim 8, wherein the substituent for Q is an electron attractive group represented by the formula (2) below:

(2)

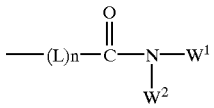

where L represents a linking group; $W^1$ and $W^2$ independently represent a hydrogen atom, alkyl group, aryl group or heterocyclic group; and n represents 0 or 1.

10. The high-speed photothermographic material as claimed in claim 7, wherein the photosensitive silver halide and binder are contained in a image producing layer of the photothermographic material, and 50 wt % or more of the binder is composed of a polymer latex having a glass transition point of −30° C. to 40° C.

11. The high-speed photothermographic material as claimed in claim 7, wherein the reducing agent is a hindered phenol compound having one hydroxyl group on a benzene ring and at least one substituent at one ortho position.

12. The high-speed photothermographic material as claimed in claim 7, wherein the reducing agent is 1,1-bis (2-hydroxy-3,5-dimethylphenyl)-3,5,5-trimethylhexane.

* * * * *